US010392801B2

(12) United States Patent
Cornia et al.

(10) Patent No.: US 10,392,801 B2
(45) Date of Patent: Aug. 27, 2019

(54) MODULAR STORAGE STRUCTURE

(71) Applicant: Justrite Manufacturing Company LLC, Mattoon, IL (US)

(72) Inventors: Anthony Dirk Cornia, North Wilkesboro, NC (US); Francisco Sergio Lira, Millers Creek, NC (US)

(73) Assignee: JUSTRITE MANUFACTURING COMPANY, LLC, Des Plaines, IL (US)

( * ) Notice: Subject to any disclaimer, the term of this patent is extended or adjusted under 35 U.S.C. 154(b) by 0 days.

(21) Appl. No.: 14/859,249

(22) Filed: Sep. 18, 2015

(65) Prior Publication Data

US 2016/0083961 A1 Mar. 24, 2016

Related U.S. Application Data

(60) Provisional application No. 62/052,346, filed on Sep. 18, 2014.

(51) Int. Cl.

| | |
|---|---|
| ***E04C 2/38*** | (2006.01) |
| ***E04B 2/00*** | (2006.01) |
| ***E04H 7/04*** | (2006.01) |
| ***E04H 7/30*** | (2006.01) |
| ***E04B 1/08*** | (2006.01) |

(52) U.S. Cl.

CPC ..... *E04C 2/38* (2013.01); *E04B 1/08* (2013.01); *E04C 2/44* (2013.01); *E04H 7/04* (2013.01); *E04H 7/30* (2013.01)

(58) Field of Classification Search

CPC ..... E04B 2/56; E04B 1/92; E04C 2/38; E04C 2/44; E04H 5/02; E06B 1/02

USPC ..... 52/215

See application file for complete search history.

(56) References Cited

U.S. PATENT DOCUMENTS 1,778,889 A * 10/1930 Disbro ..... E04C 2/08 52/262
3,568,388 A * 3/1971 Flachbarth et al. .... E04C 2/322 52/241
4,267,679 A * 5/1981 Thompson ..... E04C 2/292 52/478
4,561,233 A * 12/1985 Harter ..... E04F 13/12 52/506.1

(Continued)

OTHER PUBLICATIONS

WIPO, PCT International Search Report for Application No. PCT/US2015/051099, dated Dec. 11, 2015, 2 pp.

(Continued)

*Primary Examiner* — Paola Agudelo
(74) *Attorney, Agent, or Firm* — Leydig, Voit & Mayer, Ltd.

(57) ABSTRACT

A modular storage structure can be constructed from a number of modular wall panels and modular roof panels. Multiple modular wall panels can be joined to form a wall system of the storage structure. The wall panels can be serially connected together such that a J-shaped interlock member of one panel is in abutting relationship with a corresponding J-shaped interlock member of another wall panel to define a series of wall stud assemblies adapted to receive fasteners for joining wall layers. The roof panels can be serially connected together in a similar fashion. In embodiments, the storage structure can be constructed such that it meets the predetermined requirements for a fire rating (e.g. a 2-hour or a 4-hour fire rating).

17 Claims, 44 Drawing Sheets

(56) References Cited

U.S. PATENT DOCUMENTS 4,592,175 A * 6/1986 Werner ..... E04H 1/04 52/79.9
4,633,634 A * 1/1987 Nemmer ..... E04B 2/62 52/275
4,928,468 A * 5/1990 Phillips ..... E04B 1/383 109/78
5,979,136 A * 11/1999 Marschak ..... E04C 2/08 52/462
6,330,775 B1 * 12/2001 Hubbard ..... E04B 2/7448 52/238.1
6,415,557 B1 * 7/2002 McCalley ..... E04B 1/08 109/1 S
6,415,558 B1 7/2002 Cherry
6,568,144 B2 * 5/2003 Meredith ..... E04C 2/08 52/300
6,581,337 B1 * 6/2003 Skov ..... E04H 1/1205 52/79.5
7,080,489 B2 * 7/2006 Jedrzejewski ..... E04H 1/1205 52/272
7,356,970 B1 * 4/2008 Frobosilo ..... E04B 1/08 52/261
8,146,314 B2 * 4/2012 Nguyen ..... E04B 1/08 52/241
2003/0230038 A1 * 12/2003 Seavy ..... E04B 1/08 52/270
2012/0000139 A1 * 1/2012 Williams ..... E04B 1/08 52/11

OTHER PUBLICATIONS

European Patent Office, Extended European Search Report in European Patent Application No. 15842163.6 (dated May 11, 2018).
International Bureau of WIPO, International Preliminary Report on Patentability in International Application No. PCT/US2015/051099 (dated Mar. 30, 2017).

* cited by examiner

MODULAR STORAGE STRUCTURE

CROSS-REFERENCE TO RELATED APPLICATION

This patent application claims the benefit of priority to U.S. Patent Application No. 62/052,346, filed Sep. 18, 2014, and entitled "Modular Storage Structure," which application is incorporated in its entirety herein by this reference.

TECHNICAL FIELD

The present disclosure relates to modular storage structures and, more particularly, to storage structures for containing hazardous materials.

BACKGROUND

Storage buildings and lockers are prefabricated structures configured to provide an enclosure that acts as a storage area. Storage buildings and lockers can be used, for example, as storage enclosures for hazardous materials or for other applications such as equipment shelters, storm shelters, gas rescue lockers or remote site structures. Hazardous material storage buildings can be used for storing flammable liquids and other hazardous chemicals. As such, hazardous material storage buildings may need to comply with various governmental regulatory standards, such as those promulgated by the Occupational Safety Hazard Agency (OSHA) and the Environmental Protection Agency (EPA), for example. In some instances, the storage buildings are designed to meet a required fire rating. The buildings are often designed such that they are weather tight. Storage buildings can be designed to include walls and an affixed roof and can include a door or other opening to allow access into the storage building.

U.S. Pat. No. 6,415,557 is entitled, "Protective Shelter," and is directed to a protective shelter that is made from a plurality of elongate, vertical C-shaped panels that have web portions and perpendicular side portions, and are butt connected together with fasteners that are located in a section of the side portions that are closest to the inside portion of the shelter. A connecting cap is connected around the side portions of at least some of the adjacent panels. A cap connects a roof to the upper portions of the panels, and the lower parts of the panels are connected with fasteners to a base that in turn is connected to a floor.

There is a continued need in the art to provide additional solutions to enhance the performance of storage structures. For example, there is a continued need for storage structures that can withstand the deleterious effects of tire for a predetermined amount of time, for example, in the event that the contents of the storage structure should combust. There is also a continued need for storage structures that can store hazardous materials and withstand a desired load condition.

It will be appreciated that this background description has been created by the inventors to aid the reader, and is not to be taken as an indication that any of the indicated problems were themselves appreciated in the art. While the described principles can, in some respects and embodiments, alleviate the problems inherent in other systems, it will be appreciated that the scope of the protected innovation is defined by the attached claims, and not by the ability of any disclosed feature to solve any specific problem noted herein.

SUMMARY

In one aspect, the disclosure describes embodiments of a modular storage structure for storing hazardous materials. In one embodiment, a structure includes a wall system and a roof. The wall system includes a plurality of wall panels connected serially together. Each wall panel has a lower end, an upper end, a central wall portion, and a pair of wall interlock members. The central wall portion has an outer face surface, an inner face surface, and a pair of side edges extending between the upper end and the lower end. The wall interlock members are respectively disposed at the side edges of the central wall portion.

Each interlock member includes a wall rib portion and a wall stud portion. The wall rib portions of the wall interlock members respectively extend from the side edges of the central wall portion to a distal edge thereof. The wall stud portions of the wall interlock member respectively extend from the distal edge of the respective wall rib portion toward the wall stud portion of the other wall interlock member. The wall panels are connected together such that the wall rib portion of one of the wall interlock members of one wall panel is in abutting relationship with the wall rib portion of one of the wall interlock members of an adjacent wall panel such that the wall stud portions of the abutting wall rib portions extend away from each other to define a wall stud assembly.

The roof is connected to the wall system at the upper ends of the wall panels. The roof and the wall system cooperate together to define an interior enclosure.

In another embodiment, a structural panel includes a central wall portion and a pair of interlock members. The central wall portion has an outer face surface, an inner face surface, a pair of ends in longitudinal spaced relationship to each other, and a pair of side edges in lateral spaced relationship to each other. The side edges extend longitudinally between the pair of ends. The interlock members are respectively disposed at the side edges of the central wall portion.

Each interlock member includes a rib portion, a stud portion, and a return segment. The rib portions of the interlock members respectively extend from the side edges of the central wall portion to a distal edge thereof. The stud portions of the interlock members respectively extend from the distal edge of the respective rib portion toward the stud portion of the other interlock member. The return segments respectively extend from the stud portion of the respective interlock member toward the central wall portion.

In still another embodiment, a method of constructing a structure is described. In the method, a plurality of wall panels is arranged to form a wall system. Each wall panel includes a lower end, an upper end, a central wall panel portion, and a pair of wall interlock members. The central wall panel portion has an outer surface and an inner surface. The wall interlock members are respectively disposed on opposite sides of the central wall panel portion and extend from the inner surface of the central wall panel portion. Each wall interlock member includes a rib portion extending from the inner surface of the central wall panel portion, a stud portion extending from an outer surface of each rib portion toward the stud portion of the other wall interlock member, and a return segment extending from the stud portion toward the central wall panel portion The wall panels are connected serially together such that the outer surfaces of the rib portion of one of the interlock members of one wall panel is in abutting relationship with the outer surface of the rib portion of one of the interlock members of an adjacent wall panel such that the stud portions of the abutting rib portions extend away from each other to define a wall stud assembly.

Further and alternative aspects and features of the disclosed principles will be appreciated from the following detailed description and the accompanying drawings. As will be appreciated, the principles related to modular storage structures and structural panels disclosed herein are capable of being carried out in other and different embodiments, and capable of being modified in various respects. Accordingly, it is to be understood that both the foregoing general description and the following detailed description are exemplary and explanatory only and do not restrict the scope of the appended claims.

Figure 1A:
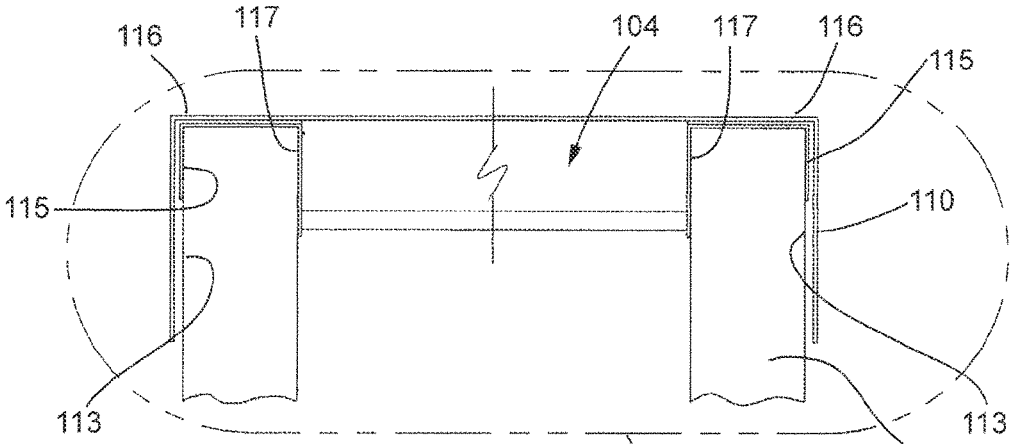
FIG. 1A is an enlarged, detail view taken from FIG. 1, as indicated by the circle therein.

It should be understood that the drawings are not necessarily to scale and that the disclosed embodiments are sometimes illustrated diagrammatically and in partial views. In certain instances, details which are not necessary for an understanding of this disclosure or which render other details difficult to perceive may have been omitted. It should be understood, of course, that this disclosure is not limited to the particular embodiments illustrated herein.

DETAILED DESCRIPTION

The disclosure relates to a modular structure that can be used, for example, for storing hazardous waste material. The modular storage structure can be constructed from a number of modular wall panels and modular roof panels. The panels can be connected together serially such that J-shaped interlock members at the sides of each panel are engaged to form a stud/joist assembly.

In embodiments, at least one wall layer can be secured to the stud/joist assemblies to increase the fire resistance of the modular storage structure. Suitable fasteners can be used to secure one or more wall layers to the stud/joist assemblies. In embodiments, the stud assembly created by the adjacent panels allow for wallboard layers to be attached. In some embodiments, the wallboard layers are gypsum drywall boards. In embodiments, the wallboard layers can be affixed to the panel by inserting fasteners into the stud/joist assemblies and by using reinforcing members. The wallboard layers can be affixed to the panels such that there is a cavity between the wallboard layer and the panels where insulation can be placed. In some embodiments, the wallboard layers can be arranged such that the seams formed by the ends of the individual boards of one wall layer are staggered with respect to the seams formed by individual boards of each adjacent wall layer.

A roof made of modular roof panels can be affixed to the wall system. The panels used to make up the roof structure can be substantially identical to the panel used to construct the wall system, and have roof interlock members adapted to allow attachment of panels to one another and to form a plurality of joist assemblies. In embodiments, the roof structure can include multiple roof layers (such as layers of gypsum drywall boards, for example) arranged such that the seams formed by the ends of the individual boards are staggered. In some embodiments, wall and roof layers and reinforcing members can be omitted. In some embodiments, the building constructed from the wall system and roof can include a door or other opening which can be installed and framed in a number of known ways.

In embodiments, a modular storage structure constructed according to principles of the present disclosure can be used to store a variety of hazardous materials, including materials that are combustible, explosive, corrosive, and/or toxic. For example, in embodiments, the modular storage structure can be used to store any of the following: (1) corrosive solids, liquids, or gases; (2) flammable solids, liquids, or gases; (3) flammable cryogenic fluids; (4) inert cryogenic fluids; (5) inert gases; (6) organic peroxide formulations; (7) oxidizer solids, liquids, gases; (8) oxidizing cryogenic fluids; (9) pyrophoric solids, liquids, or gases; (10) toxic or highly toxic solids, liquids, or gases; (11) unstable (reactive) solids, liquids, or gases; and (12) water-reactive solids or liquids. In embodiments, a modular storage structure constructed according to principles of the present disclosure can include an explosion relief panel constructed to open when the pressure within the interior of the modular storage structure exceeds a predetermined amount (e.g., 20 psi).

In embodiments, a modular storage structure constructed according to principles of the present disclosure can have a wall system and a roof that are constructed such as to comply with a fire rating standard (e.g. a 2-hour or a 4-hour fire rating) established by FM Approvals of Norwood, Mass., as set forth in "Approval Standard for Storage Buildings and Lockers," Class Number 6049, published December 2013 (also referred to herein as, "FM Approval Standard 6049"). In embodiments, the wall system and the roof of a modular storage structure constructed according to principles of the present disclosure satisfy a fire-endurance rating for walls and roofs (e.g., a 2-hour rating or a 4-hour rating) determined according to the specifications published by the American Society for Testing and Materials (ASTM) as E119-15, "Standard test Methods for Fire Tests of Building Construction and Materials."

In at least some of such embodiments, multiple layers of gypsum wallboard are applied to the interior of the modular storage structure defined by the wall system and the roof and encased between an exterior steel layer and an interior sheet steel. In embodiments, at least one layer of gypsum wallboard is applied to the interior of the modular storage structure defined by the wall system and the roof. In embodiments, at least one layer of gypsum wallboard applied to the interior of the modular storage structure defined by the wall system and the roof comprises gypsum panels constructed to inhibit the transmission of heat therethrough to meet the one-hour fire-resistance rating to be classified as "Type X" board under ASTM C1396/C1396M-14a.

In embodiments, the ability of a modular storage structure to resist fire and the associated extreme heat may be evaluated by carrying out generally-accepted tests. Examples of such tests are routinely used in the construction industry, such as those published by Underwriters Laboratories ("UL"), such as the UL U305, U419 and U423 test procedures and protocols, as well as procedures described in the specifications of FM Approval Standard 6049 and ASTM E119-15. Depending on the test, the storage structure may or may not be subjected to load forces.

In embodiments, a modular storage structure constructed according to principles of the present disclosure can have a wall system and a roof constructed so as to satisfy the requirements for having a "non-combustible" construction according to FM Approval Standard 6049. In embodiments, the wall system and the roof of the modular storage structure are made from materials that will not ignite, burn, support combustion or release flammable vapors when subjected to fir or heat according to the criteria set forth in ASTM E136-12, "Standard Test Method for Behavior of Materials in a Vertical Tube Furnace at 750° C."

In embodiments, a modular storage structure constructed according to principles of the present disclosure can be constructed so as to be in compliance with various codes published by the National Fire Protection Association (NFPA). For example, in embodiments, a modular storage structure constructed according to principles of the present disclosure is constructed so as to be in compliance with NFPA 30 (2015). "Flammable and Combustible Liquids Code," Chapter 14, "Hazardous Materials Storage Lockers," and/or NFPA 1 (2015), "Fire Code," Chapter 66.14. "Hazardous Materials Storage Lockers."

Figure 1:
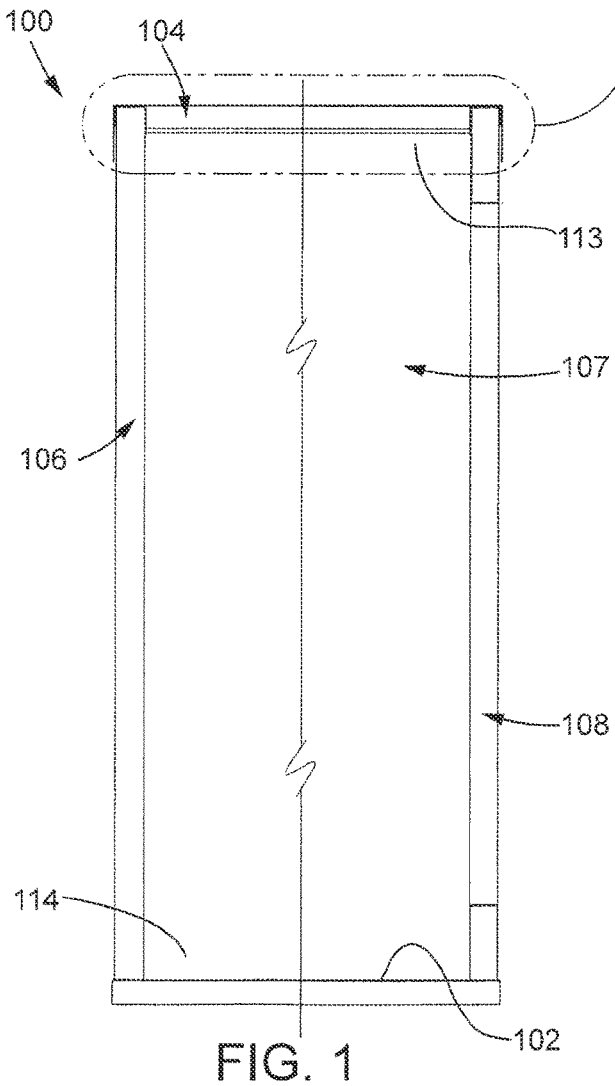
FIG. 1 is a fragmented, interior wall elevational view, in longitudinal section, of an embodiment of a modular storage structure constructed according to principles of the present disclosure.

Referring now to the drawings, FIGS. 1-12 illustrate several different views of an embodiment of a modular storage structure 100. FIG. 1 shows a sectional side view of the modular storage structure 100, which includes a floor 102, a roof 104, and a wall system 106. The roof 104 and the wall system 106 cooperate together to define an interior enclosure 107.

The floor 102, the roof 104, and the wall system 106 can be made from any suitable material, such as, metal, for example. The illustrated storage structure 100 is constructed to satisfy the "non-combustible" construction standard set forth in FM Approval Standard 6049. The storage structure 100 is constructed to withstand at least a wind pressure of ±28 lb/ft$^2$ (0.7 kPa) inward and outward based on a wind speed of 90 mph (40 m/s) according to the specifications of FM Approval Standard 6049. The roof 104 of the storage structure 100 is constructed to withstand at least a combined roof (live and snow) load of 40 lb/ft$^2$ (195 kg/m$^2$) according to the specifications of FM Approval Standard 6049. The floor 102 is constructed to provide a load capacity of at least 250 lb/ft$^2$ (1220 kg/m$^2$) under dry conditions according to the specifications of FM Approval Standard 6049.

In embodiments, the wall system 106 can define a door opening 108. The door opening 108 is in communication with the interior enclosure 107. In embodiments, a door can be installed on the storage structure 100 to at least partially and selectively occlude the door opening 108.

Figure 2A:
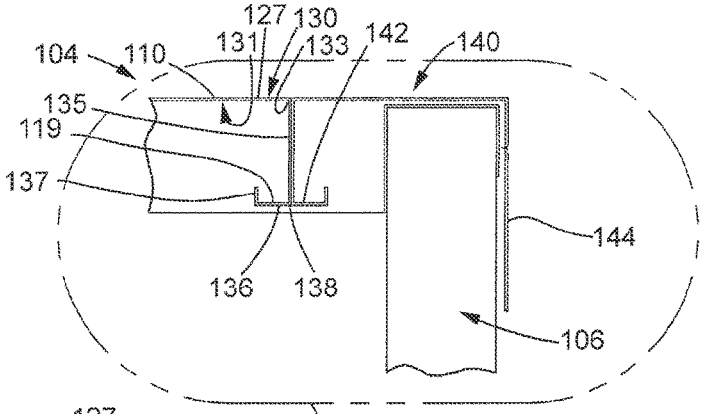
FIG. 2A is an enlarged, detail view taken from FIG. 2, as indicated by the circle therein.
Figure 2:
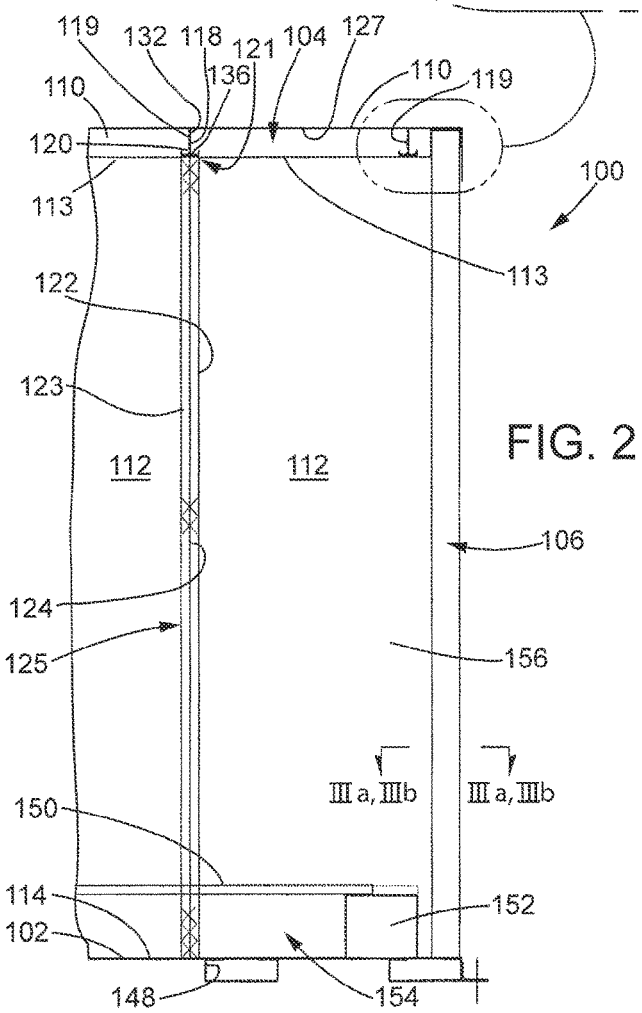
FIG. 2 is a partial, interior wall corner elevational view, in longitudinal section, of the modular storage structure of FIG. 1.

Referring to FIGS. 1 and 2, the roof 104 includes a plurality of roof panels 110 connected serially together. The wall system 106 includes a plurality of wall panels 112 connected serially together. In embodiments, the roof 104 is connected to the wall system 106 at the upper ends 113 of the wall panels 112 using any suitable technique. The floor 102 engages the lower ends 114 of the wall panels 112.

In embodiments, the roof panels 110 are substantially identical to each other. In embodiments, the wall panels 112 are substantially identical to each other. In the illustrated embodiment, the roof panels 110 and the wall panels 112 are each substantially identical to each other. In the illustrated embodiment, the roof panels 110 and the wall panels 112 both comprise a structural panel.

FIG. 1 also shows a detailed view of the roof 104 and the roofs intersection with the wall system 106. Referring to FIG. 1A, a wall track 115 can engage the upper ends 113 of the wall panels 112 adjacent the roof panels 110. In the illustrated embodiment, the wall track 115 has a generally U-shaped cross-section. Each end 116 of the roof panels 110 can include a channel 117 configured to accommodate a respective wall track 115 therein to facilitate the interengagement between the roof 104 and the wall system 107. A suitable connection technique can be used to secure the roof 104 to the wall system 107, such as, an appropriate weld schedule as will be appreciated by one skilled in the art.

FIG. 2 shows a partial front view an interior rear corner of the modular storage structure 100. In FIG. 2, two roof panels 110 are connected together with a suitable weld pattern (such as, at each end and in the middle of each roof panel). The two roof panels 110 are in abutting relationship at one of each of a pair of respective roof interlock members 118, 119 to form a roof panel seam 120 and a joist assembly 121.

In FIG. 2, two roof panels 110 are in abutting relationship at one of each of a pair of respective roof interlock members 118, 119 to form a roof panel seam 120 and a joist assembly 121. The two roof panels 110 can be connected together at the roof panel seam 120 using any suitable technique, such as, with a suitable weld pattern (such as, at each end and in the middle of each roof panel). In embodiments, the roof 104 can include a series of repeating joist assemblies 121 which are similarly constructed by additional roof panels 110.

In FIG. 2, two wall panels 112 are in abutting relationship at one of each of a pair of respective wall interlock members 122, 123 to form a wall panel seam 124 and a stud assembly 125. The two wall panels 112 can be connected together at the wall panel seam 124 using any suitable technique, such as, with a suitable weld pattern (such as, at each end and in the middle of each wall panel 112, as shown). In embodiments, the wall system 106 can include a series of repeating stud assemblies 125 which are similarly constructed by additional wall panels 112. In embodiments, the stud assemblies 125 can be aligned with a respective joist assembly 121.

Referring to FIG. 2, each roof panel 110 includes a central roof portion 127 and the pair of roof interlock members 118, 119. The roof interlock members 118, 119 are generally J-shaped and are mirror images of each other. Accordingly, it should be understood that the description of one roof interlock member is applicable to the other, as well.

Referring to FIGS. 2 and 2A, the central roof portion 127 has an outer top surface 130, an inner top surface 131, and a pair of lateral edges 132, 133. The roof interlock members 118, 119 are respectively disposed at the lateral edges 132, 133 of the central roof portion 127. Referring to FIG. 2A, the roof interlock member 119 extends from the inner top surface 131 of the central roof panel portion 127. The roof interlock member including a roof rib portion 135, a roof joist portion 136, and a roof return segment 137. The roof rib portion 135 of the roof interlock member 119 extends from the lateral edge 133 of the central roof portion 127 to a distal edge 138 thereof. The roof joist portion 136 of the roof interlock member 119 extends from the distal edge 138 of the roof rib portion 135 toward the roof joist portion 136 of the other roof interlock member 118 (see FIG. 2, also). The roof return segment 137 extends from the roof joist portion 136 toward the central roof portion 127. Referring to FIG. 2, the roof panels 110 are connected together such that the roof rib portion 135 of one of the roof interlock members 118 of one roof panel 110 is in abutting relationship with the roof rib portion 135 of one of the roof interlock members 119 of an adjacent roof panel 110 such that the roof joist portions 136 of the abutting roof rib portions extend away from each other to define the roof joist assembly 121.

Referring to FIG. 2A, the roof 104 includes a terminal roof panel 140 at each end thereof. The terminal roof panel 140 includes a terminal roof interlock member 142 and a roof cover portion 144. The terminal roof interlock member 142 has the same configuration as one of the roof interlock members 118 of the roof panel 110. The roof cover portion 144 is configured to overhang the wall system 106. The roof cover portion 144 can be connected to the wall system 106 such as by being welded thereto.

The embodiment in FIG. 2 also shows a plurality of forklift pockets 148 connected to the floor 102. Each forklift pocket 148 can be configured to receive a lift tine of a suitable forklift to facilitate the ready transport of the modular storage structure 100 from one location to another.

A grate 150 is supported by a grating support 152 such that the grate 150 is in spaced relationship to the floor 102 to define a sump area 154. In embodiments, the sump area 154 provides a spill containment system adapted to prevent the flow of liquids from the structure 100 under emergency conditions. In embodiments, the containment system includes sufficient capacity to contain at least ten percent (and, in some embodiments, up to twenty-five percent) of the volume of containers allowed in the structure 100 or the volume of the largest container, whichever is greater. In embodiments, the sump area 154 is constructed of steel with continuously welded leak-tight seams. In embodiments, the sump area 154 is coated with a corrosion-resistant liner.

Figure 3A:
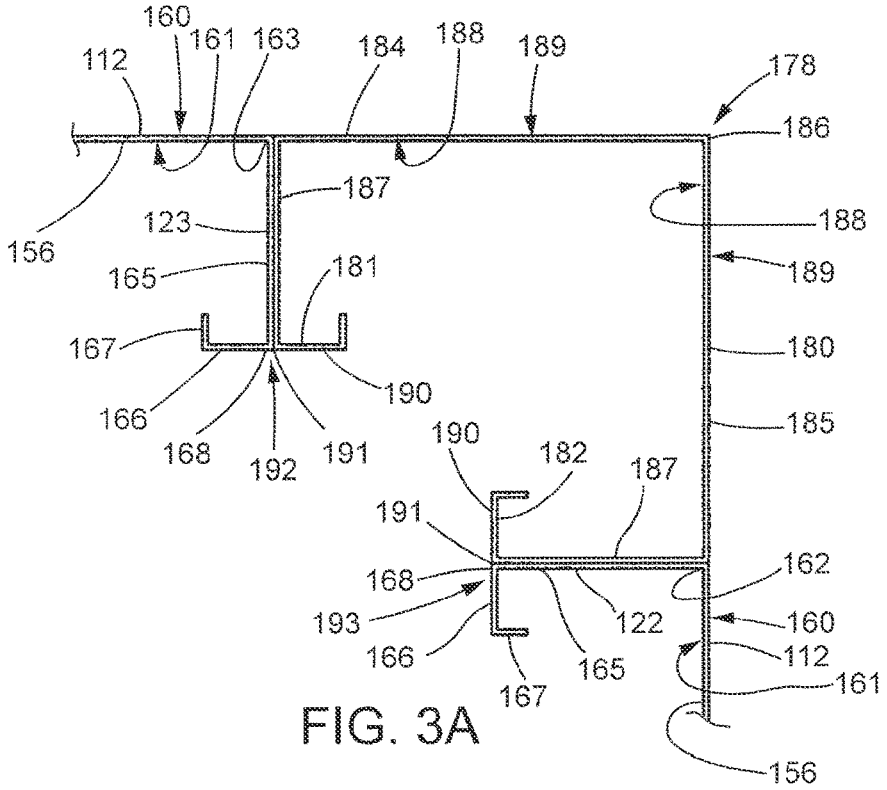
FIG. 3A is a cross-sectional view, taken along line IIIa-IIIa in FIG. 2, of the wall corner of the modular storage structure of FIG. 1.

Referring to FIGS. 2 and 3A, each wall panel 112 includes a central wall portion 156 and the pair of wall interlock members 122, 123. The wall interlock members 122, 123 are generally J-shaped and are mirror images of each other. Accordingly, it should be understood that the description of one wall interlock member 122, 123 is applicable to the other, as well.

Referring to FIG. 3A, the central wall portion 156 has an outer face surface 160, an inner face surface 161, and a pair of side edges 162, 163 extending between the upper end 113 and the lower end 114 of the panel 112 (see FIG. 2 also). The wall interlock members 122, 123 are respectively disposed at the side edges 162, 163 of the central wall portion 156.

Each interlock member 122, 123 includes a wall rib portion 165, a wall stud portion 166, and a wall return segment 167. The wall rib portions 165 of the wall interlock members 122, 123 respectively extend from the side edges 162, 163 of the central wall portion 156 to a distal edge 168 thereof. The wall stud portions 166 of the wall interlock member 122, 123 respectively extend from the distal edge 168 of the respective wall rib portion 165 toward the wall stud portion 166 of the other wall interlock member 122, 123. Referring to FIG. 2, the wall panels 110 are connected together such that the wall rib portion 165 of one of the wall interlock members 122 of one wall panel 110 is in abutting relationship with the wall rib portion 165 of one of the wall interlock members 123 of an adjacent wall panel 110 such that the wall stud portions 166 of the abutting wall rib portions 165 extend away from each other to define the wall stud assembly 125.

Figure 3B:
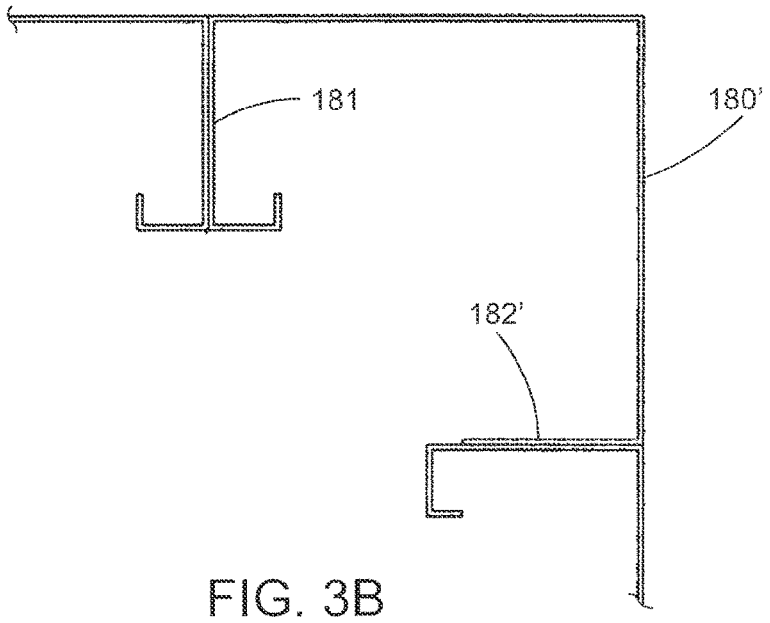
FIG. 3B is a cross-sectional view, taken along line IIIb-IIIb in FIG. 2, of another embodiment of a wall corner suitable for use with the modular storage structure of FIG. 1.

FIGS. 3A and 3B show top sectional views of embodiments of a rear corner 178 of the modular storage structure 100. In embodiments, the rear wall corner 178 is formed by joining two wall panels 112 with a corner wall panel 180. In FIG. 3A, the corner wall panel 180 includes two J-shaped corner interlock members 181, 182 that engage the wall interlock members 123, 122 of the adjacent wall panels 112. The corner wall panel 180 is disposed between two wall panels 112 so as to form the wall corner 178.

The corner wall panel 180 includes first and second substantially flat corner portions 184, 185 disposed at an angle to one another and meeting at a corner edge 186. The first and second corner portions 184, 185 each have an inner surface 188 and an outer surface 189. The first corner interlock member 181 includes a first corner rib portion 187 extending from the inner surface 188 of the first corner portion 184, and the second corner interlock member 182 includes a second corner rib portion 181 extending from the inner surface 188 of the second corner portion 185. The corner wall panel 180 is disposed such that the first corner rib portion 187 abuts the wall rib portion 165 of one of the wall interlock members 123 of a first adjacent wall panel 110, and the second corner rib portion 187 abuts the wall rib portion 165 of one of the wall interlock members 122 of a second adjacent wall panel 110.

The first corner interlock member 181 includes a first corner stud portion 190 extending substantially away from a distal edge 191 of the first corner rib portion 187 so as to form a first corner stud assembly 192 with the wall stud portion 166 of the abutting interlock member 123 of the first adjacent wall panel 110. The second corner interlock member 182 includes a second corner stud portion 190 extending substantially away from a distal edge 191 of the second corner rib portion 187 so as to form a second corner stud assembly 192 with the wall stud portion 166 of the abutting interlock member 122 of the second adjacent wall panel 110. An alternative embodiment of a corner wall panel 180' is shown in FIG. 3B having one J-shaped corner interlock member 181 and one flat corner interlock member 182'.

Figure 4:
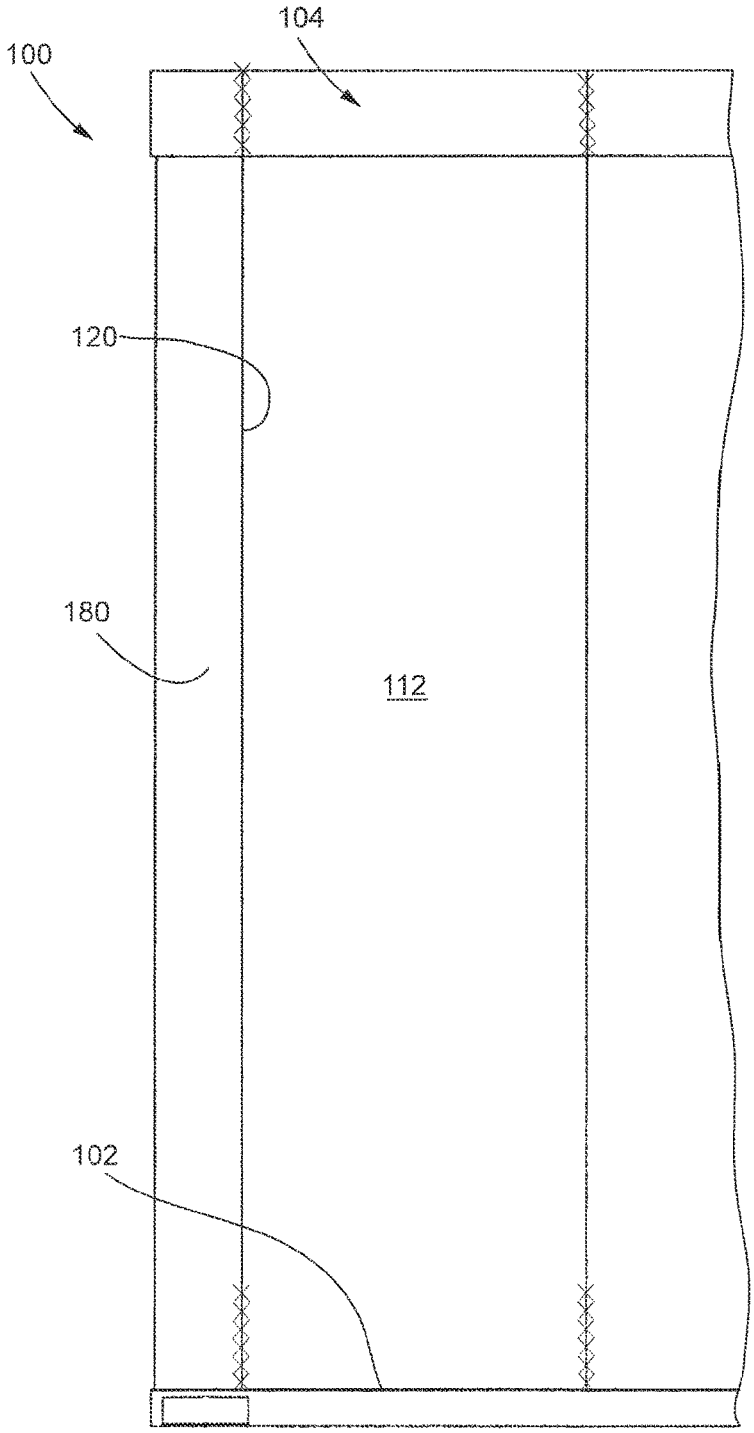
FIG. 4 is a partial, exterior wall corner elevational view of the modular storage structure of FIG. 1.
Figure 5:
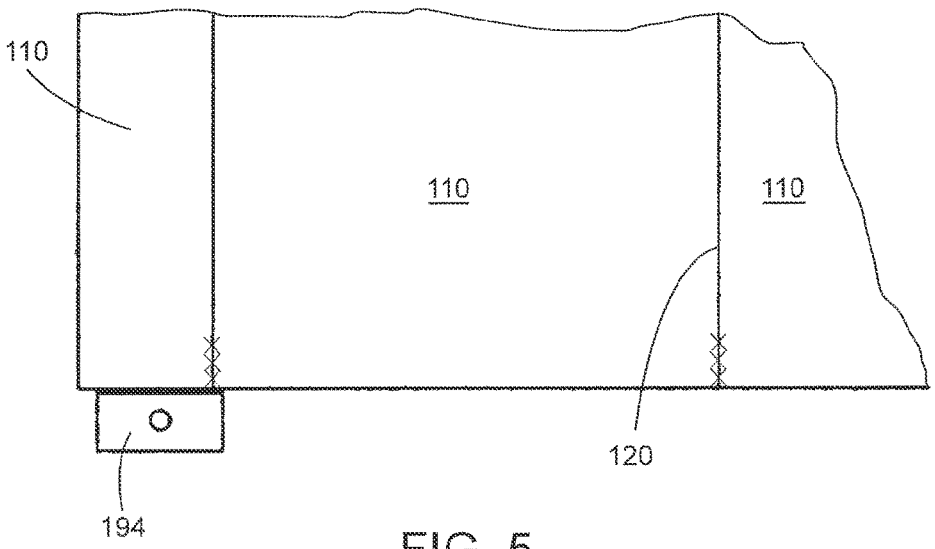
FIG. 5 is a partial, top plan view of the modular storage structure of FIG. 1.

FIG. 4 shows a partial front view of the modular storage structure 100. FIG. 4 shows the scam 120 formed between two wall panels 112 and a wall panel and a corner wall panel 180. In embodiments, each seam of the storage structure can be secured using any suitable technique, such as, welding, rivets, screws, or any other suitable fasteners. FIG. 5 is a top view of the storage structure 100 showing the roof panel seam 120 between roof panels 110. The modular storage structure 100 can include a hold-down angle bracket 194 disposed at each corner thereof.

Figure 6:
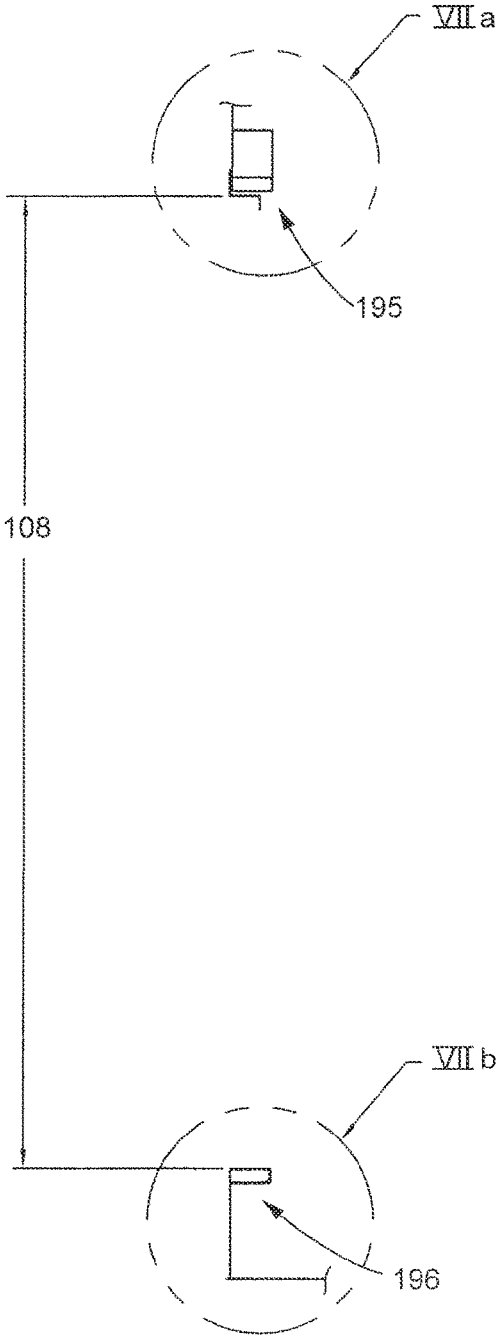
FIG. 6 is a partial, side view, in longitudinal section, of a door opening of the modular storage structure of FIG. 1.
Figure 7A:
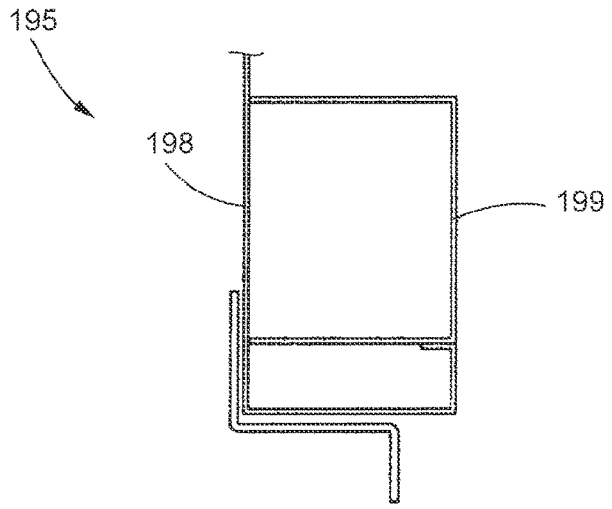
FIG. 7A is an enlarged detail view taken from FIG. 6, as indicated by circle VIIa in FIG. 6, illustrating a door frame of the modular storage structure of FIG. 1.
Figure 7B:
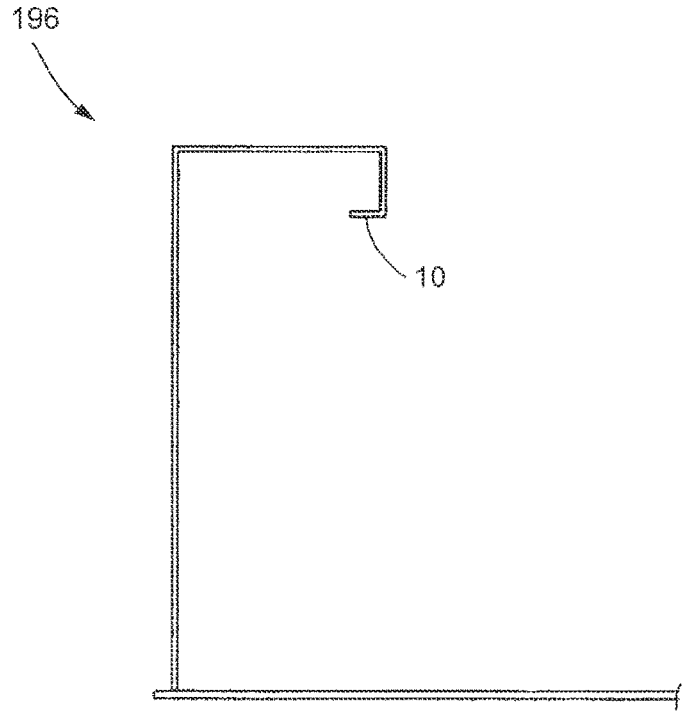
FIG. 7B is an enlarged detail view taken from FIG. 6, as indicated by circle VIIb in FIG. 6, illustrating a door threshold of the modular storage structure of FIG. 1.

FIGS. 6, 7A, and 7B show side sectional views of an embodiment of the door opening 108 and accompanying door frame 195 and door threshold 196. In such embodiments, the door frame 195 can engage with a header 198 and a stiffener 199.

Figure 8:
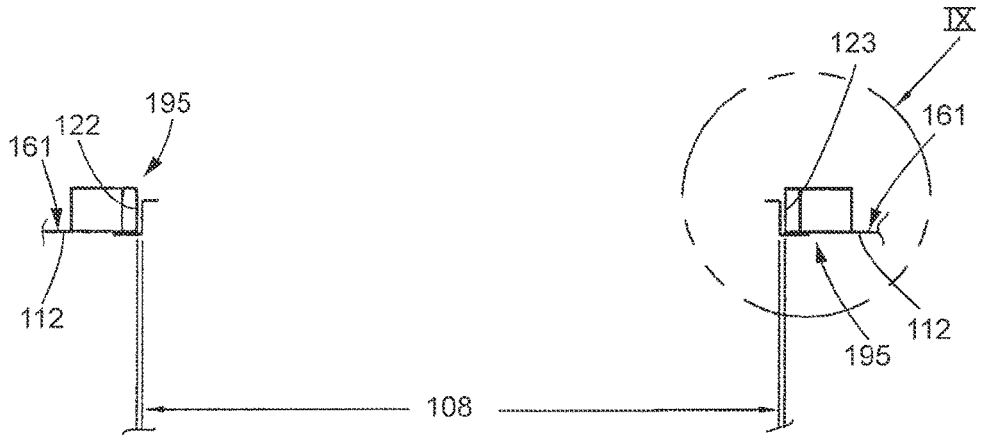
FIG. 8 is a partial, plan view, in transverse section, of the door opening of the modular storage structure of FIG. 1.
Figure 9:
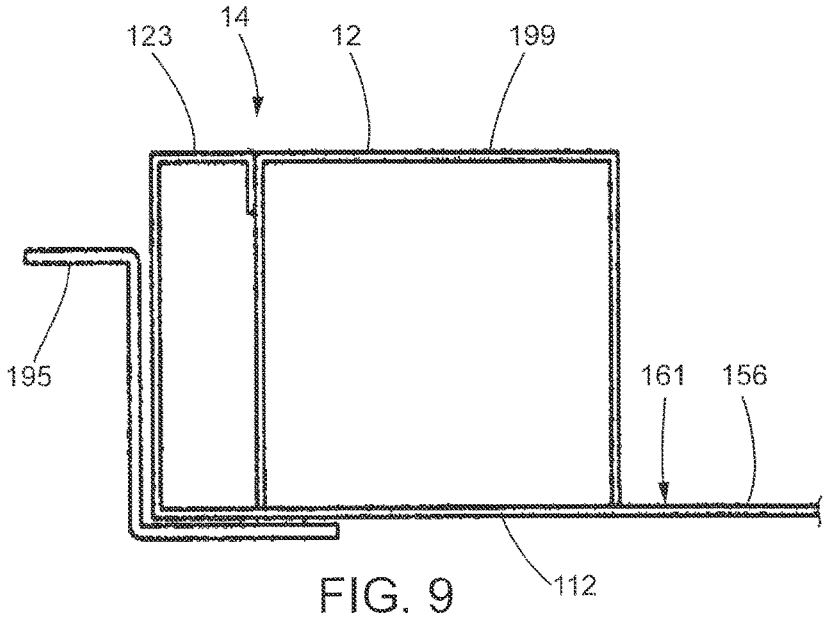
FIG. 9 is an enlarged detail view taken from FIG. 8, as indicated by circle IX in FIG. 9, illustrating the door frame of the modular storage structure of FIG. 1.

The threshold 196 can be connected to the floor 102 of the modular storage structure 100 and can have a J-shaped threshold interlock member 10. FIGS. 8 and 9 show a top view of the door opening 108 and a close-up view of the intersection between the door frame 195, the wall panel 112, and the stiffener 199. As shown, in FIG. 9, the wall interlock member 123 can engage with the stiffener 190 to provide support to the door frame 195.

Referring to FIG. 8, the modular storage structure 100 can include a pair of stiffeners 199 respectively abutting one of the wall interlocking members 122 and the inner surface of the two wall panels 112 between which the door opening 108 is defined. Referring to FIG. 9, each stiffener 199 has a stiffener stud portion 12 facing generally away from the inner surface 161 of the central wall portion 156. The stiffener 199 is disposed against the wall interlocking member 123 so as to form a door stud assembly 14 from the stud portion 166 of the interlocking member 123 and the stiffener stud portion 12.

Figure 10:
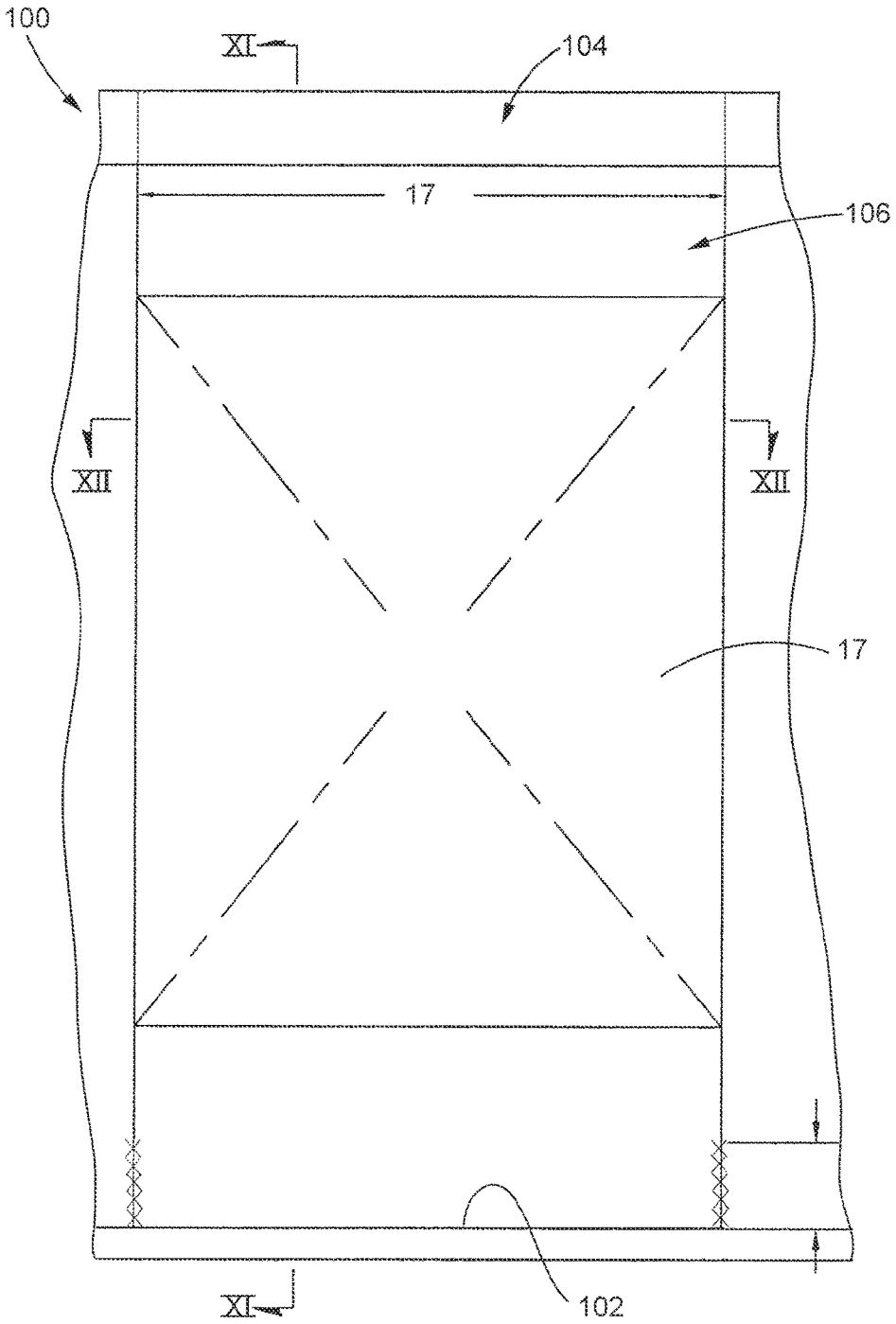
FIG. 10 is a partial, rear elevational view of the modular storage structure of FIG. 1, illustrating an explosion relief panel opening.
Figure 11:
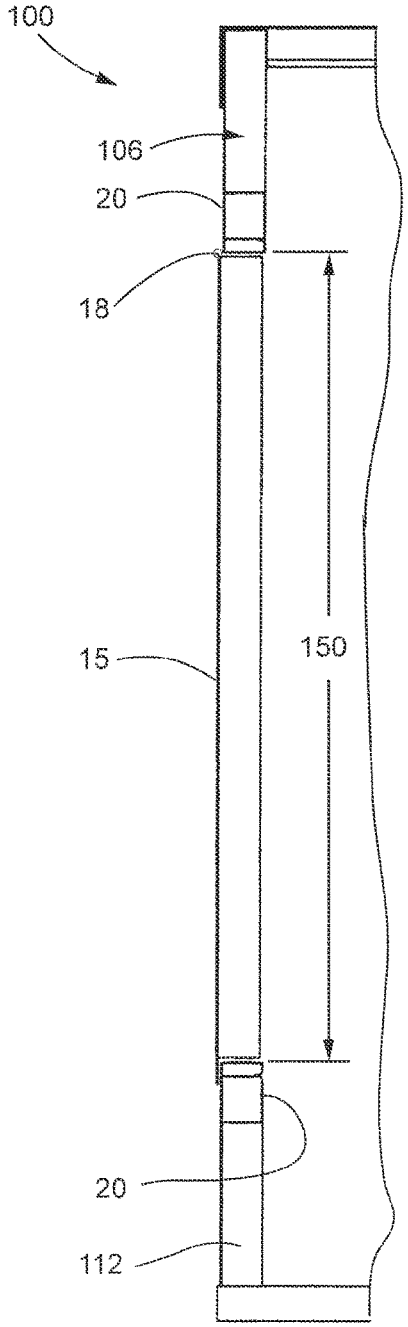
FIG. 11 is a cross-sectional view, taken along line XI-XI in FIG. 10, of the explosion relief panel opening of the modular storage structure of FIG. 1, illustrating an explosion relief panel pivotally mounted within the explosion relief panel opening.
Figure 12:
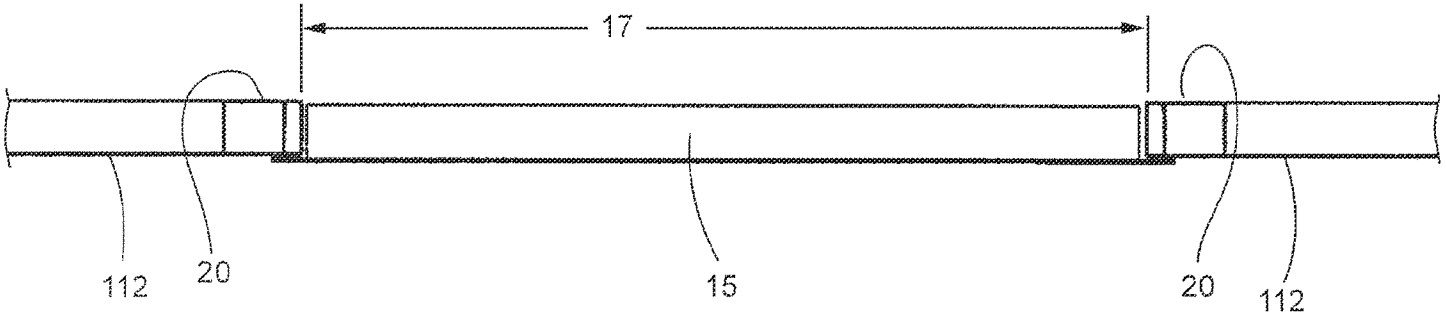
FIG. 12 is a cross-sectional view, taken along line XII-XII in FIG. 10, of the explosion relief panel opening of the modular storage structure of FIG. 1.

FIGS. 10-12 show portions of the wall system 106 of the modular storage structure 100 including an explosion relief panel (ERP) 15. The wall system 106 defines an explosion relief panel opening 17. The explosion relief panel 15 can be mounted to the wall system 106 such that the explosion relief panel 15 is disposed in the explosion relief panel opening 17. In the illustrated embodiment, the explosion relief panel 15 is pivotally mounted to the wall system 106 via a piano-style hinge 18 (see FIG. 11).

FIG. 10 shows a rear view of the modular storage structure 100 with the explosion relief panel opening 17 formed in the wall system 106. FIG. 11 shows a side sectional view of the explosion relief panel 15 installed into the explosion relief panel opening 17. The explosion relief panel opening 17 is formed between wall panels 112 and support is provided by stiffeners 20 surrounding the opening and engaging the wall panels. The ERP stiffeners 20 can be similar to the door stiffeners 199. FIG. 12 shows a top sectional view of the explosion relief panel 148 installed into the explosion relief panel opening 150.

FIGS. 13-24 illustrate another embodiment of a modular storage structure 200. The modular storage structure 200 of FIGS. 13-24 satisfies at least the two-hour tire rating standards according to the criteria of FM Approval Standard 6409 and ASTM E119-15.

Figure 13A:
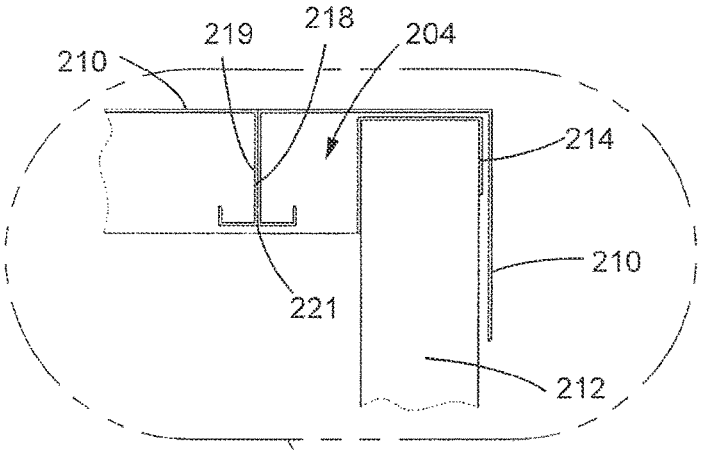
FIG. 13A is an enlarged, detail view taken from FIG. 13, as indicated by the circle therein.
Figure 13:
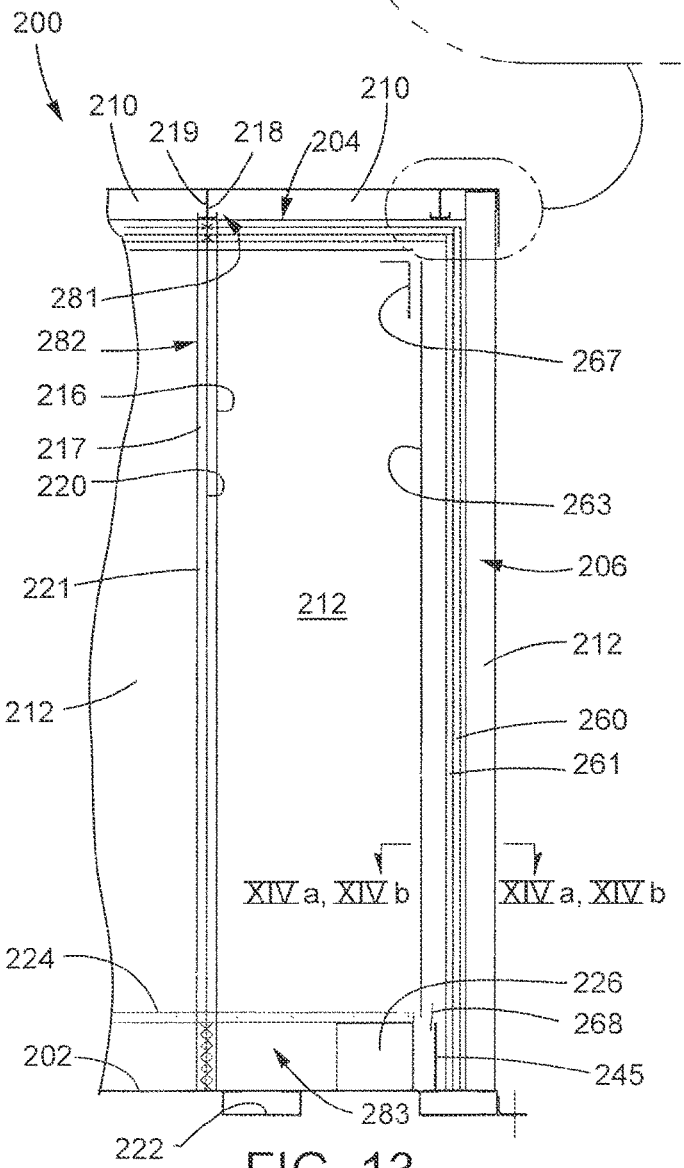
FIG. 13 is a partial, interior wall corner elevational view, in longitudinal section, of another embodiment of a modular storage structure constructed according to principles of the present disclosure.

Referring to FIG. 13, the modular storage structure 200 includes a floor 202, a roof 204, and a wall system 206. In some embodiments, a door can be installed on the structure 200 to at least partially and selectively occlude a door opening 208. FIG. 13 also shows a detailed view of the roof 204 and the roof's intersection with the wall system 206. The roof 204 includes roof panels 210, and the wall system 206 includes wall panels 212 which are constructed and function in a manner similar to that described above in connection with the storage structure 100 of FIGS. 1-12. A wall track 214 can engage upper ends of the wall panels 212 adjacent the roof panels 210.

The storage structure 200 is constructed to satisfy the "fire-rated" construction standard set forth in FM Approval Standard 6049. In the illustrated embodiment, the storage structure 200 is constructed as at least a 2-hour fire-rated storage structure. In embodiments, the wall system 206 of the modular storage structure 200 is effective to inhibit the transmission of heat through the wall system 206 such that the wall system 206 meets at least the two-hour uni-directional fire-rating standards according to the specifications of ASTM E119-15 and/or FM Approval Standard 6049. In embodiments, the roof 204 of the modular storage structure 200 is effective to inhibit the transmission of heat through the roof 204 such that the roof 204 meets at least the one and one-half hour fire-rating standards according to the specifications of ASTM E119-15 and/or FM Approval Standard 6049.

The storage structure 200 is constructed to withstand at least a 90 mph (40 m/sec) wind load applying a 32 lb/ft$^2$ (1.6 kPa) inward and −42 lb/ft$^2$ (2.1 kPa) outward wind pressure on the structure 200 according to the specifications of FM Approval Standard 6049. The roof 204 of the storage structure 200 is designed to withstand at least a combined roof (live and snow) load of 40 lb/ft$^2$ (195 kg/m$^2$) according to the specifications of FM Approval Standard 6049. The floor 202 is constructed to provide a load capacity of at least 250 lb/ft$^2$ (1220 kg/m$^2$) under dry conditions according to the specifications of FM Approval Standard 6049.

FIG. 13 shows a partial front view an interior rear corner of the modular storage structure 200 including a plurality of wall panels 212 and roof panels 210. In such embodiments, the wall panels 212 are flat sheets that terminate at a pair of side edges having J-shaped wall interlock members 216. Similarly, the roof panels 210 can have edges terminating in J-shaped roof interlock members 218. FIG. 13 shows two roof panels 210 meeting at their respective roof interlock members 218, and two wall panels 212 meeting at respective wall interlock members 216 to form a panel seam 220 and a stud 221. The embodiment in FIG. 13 also shows a forklift pocket 222 for forklift access, as well as a grating 224 supported by a grating support 226 to define a sump area.

In embodiments, the storage structure 200 includes at least one layer of wallboard 260 made from gypsum or other suitable material, and an interior skin 263 made from metal. In the illustrated embodiment, the wall system 206 includes two layers of gypsum wallboard 260, 261. The interior of the storage structure 200 can also include ceiling flashing 267 and sump flashing 268 to provide a sealed interior.

The first wallboard layer 260 has an inner wallboard surface and an outer wallboard surface. The first wallboard layer 260 substantially covers the interior enclosure formed by the roof 204 and the wall system 206. In embodiments, at least portions of the outer wallboard surface of the first wallboard layer 260 contact the roof joist assemblies 281 formed by adjacent roof panels 210 and at least portions of the outer wallboard surface contact the wall stud assemblies 282 formed by adjacent wall panels 212.

The second wallboard layer 261 also substantially surrounds the interior space formed by the roof 204 and the wall system 206. The second wallboard layer 261 engages the inner wallboard surface of the first wallboard layer 260.

In embodiments, the first and second wallboard layers 260, 261 comprise gypsum drywall panels. In embodiments, the first and second wallboard layers 260, 261 comprise gypsum drywall panels constructed to inhibit the transmission of heat therethrough to meet the one-hour fire-resistance rating to be classified as "Type X" board under ASTM C1396/C 1396M-14a. In embodiments, any suitable technique for fastening and finishing the first and second wallboard layers can be used.

In embodiments, the first wallboard layer 260 is attached to the roof joist assemblies 281 and the wall stud assemblies 282 with self-tapping steel screws spaced at twenty-four inches on center along the perimeter of the roof 204 and the wall system 206 and in the field with all joints between wallboard panels running vertically. In embodiments where the first wallboard layer 260 includes a plurality of gypsum wallboard panels, all joints can be staggered. The inner surface of the second wallboard layer 261 can have its joints covered with joint compound and paper or mesh tape can be embedded in the joint compound. Joint compound can be used to cover any exposed screw heads. An adhesive can be applied to the inner surface of the second wallboard layer 261 to apply the interior metal skin 263 thereto. Screws can also be used to secure the interior metal skin 263 to the roof joist assemblies 281 and the wall stud assemblies 282.

A sump skirt 245 can be installed tight to the inner surface of the second wallboard layer 261. The sump skirt 245 encircles the sump area 283. The sump skirt 245 can be continuously welded, watertight to the floor 202. Any vertical seams in the sump skirt 245 can also be welded watertight. The sump flashing 268 can be attached to the top of the sump skirt 245 with self-tapping screws, for example. The ceiling flashing 267 can also be attached using any suitable technique, such as, by using self-tapping screws, for instance. The ceiling flashing 267 can include corner flashing, as well. All flashing seams can have a bead of caulk applied thereto.

Figure 14B:
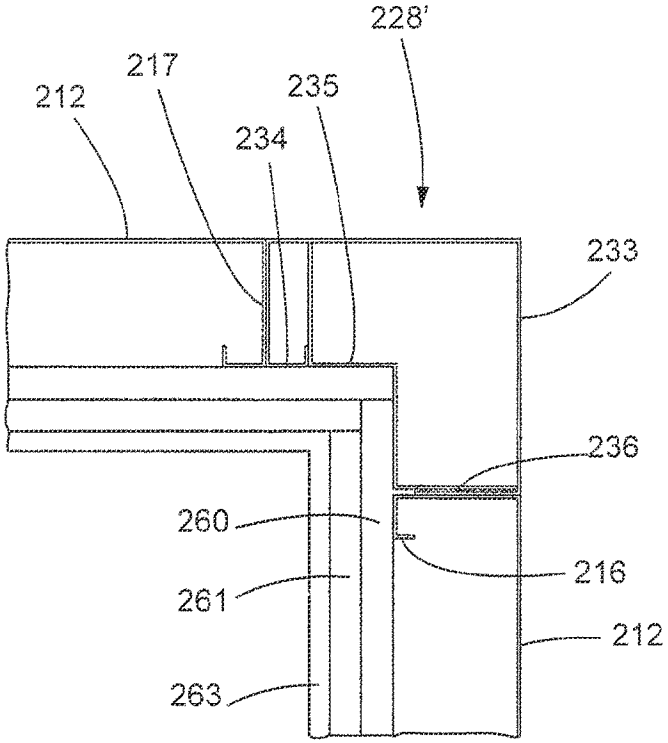
FIG. 14B is a cross-sectional view, taken along line XIVb-XIVb in FIG. 13, of another embodiment of a wall corner suitable for use with the modular storage structure of FIG. 13.
Figure 14A:
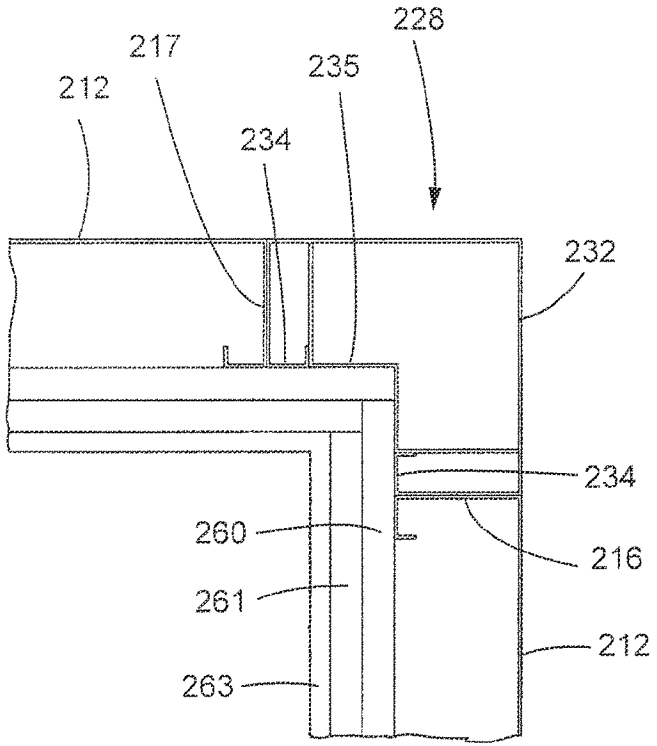
FIG. 14A is a cross-sectional view, taken along line XIVa-XIVa in FIG. 13, of the wall corner of the modular storage structure of FIG. 13.

FIGS. 14A and 14B show top sectional views of embodiments of the rear corner 228 of the modular storage structure 200. The rear corner 228 is formed where two wall panels 212 meet and are joined by a corner panel. FIG. 14A shows a corner wall panel 232 having two J-shaped corner interlock members 234 that engage the wall interlock members 216 of adjacent wall panels 212. An alternative embodiment of a corner wall panel 233 is shown in FIG. 14B having one J-shaped corner interlock member 234 and one flat corner interlock member 236. Corner insert 235 can engage with the corner wall panels 232, 233 providing structural support and support for the layers of wallboard 260 disposed against the wall panels 212.

Figure 15:
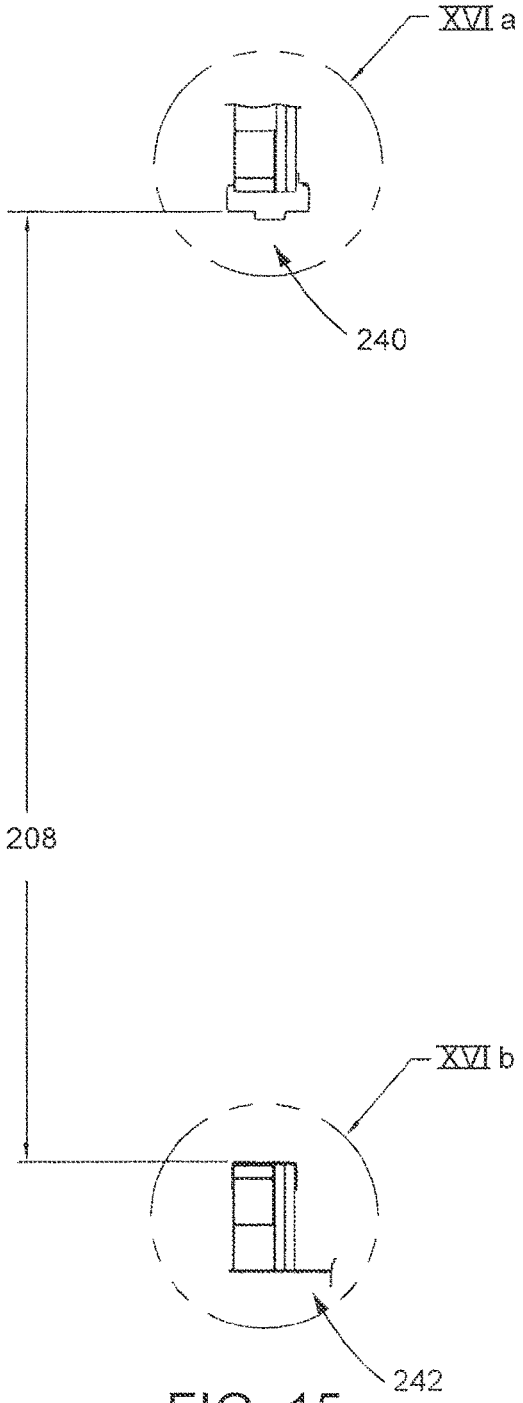
FIG. 15 is a partial, side view, in longitudinal section, of a door opening of the modular storage structure of FIG. 13.
Figure 16A:
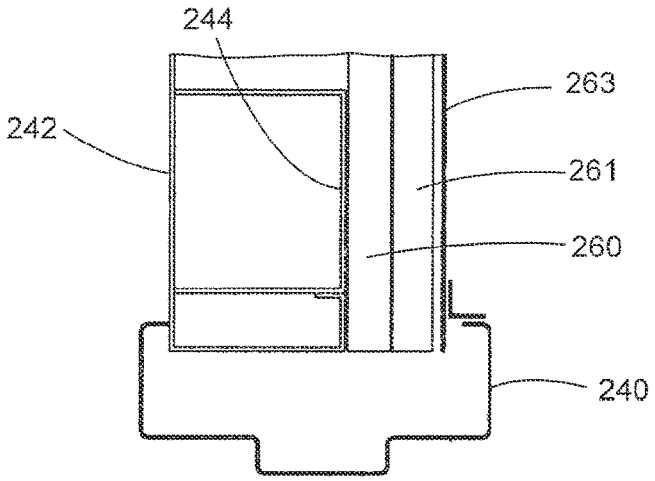
FIG. 16A is an enlarged detail view taken from FIG. 15, as indicated by circle XVIa in FIG. 15, illustrating a door frame of the modular storage structure of FIG. 13.
Figure 16B:
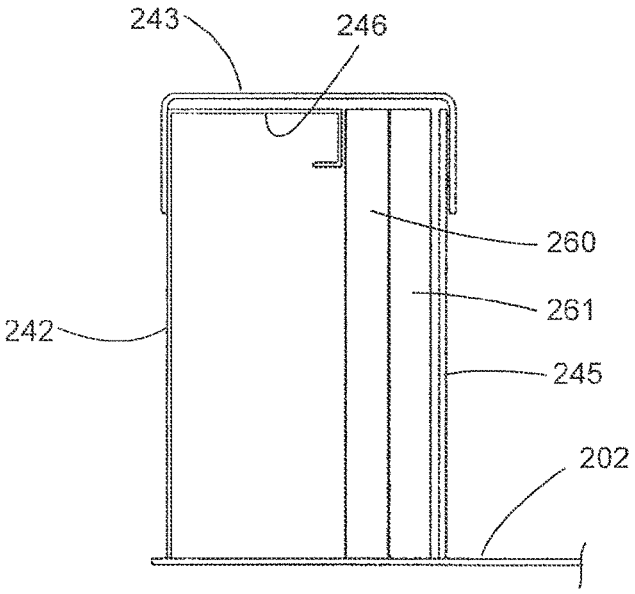
FIG. 16B is an enlarged detail view taken from FIG. 15, as indicated by circle XVIb in FIG. 15, illustrating a door threshold of the modular storage structure of FIG. 13.

FIGS. 15, 16A, and 16B show side sectional views of an embodiment of the door opening 208 and accompanying door frame 240 and door threshold 242. In such embodiments, the door frame 240 can engage with a header 242 and a stiffener 244. FIG. 16A further shows two wallboard layers 260 and an interior skin 262, where the door frame 240 separates the door opening 208. As shown in FIG. 16B, the threshold 242 can be connected to the floor 202 of the modular storage structure 200 and can have a J-shaped threshold interlock member 246. A formed channel 243 can cover the threshold 242, the plurality of wallboard layers 260, 261, and the sump skirt 245, separating from the door opening 208.

Figure 17:
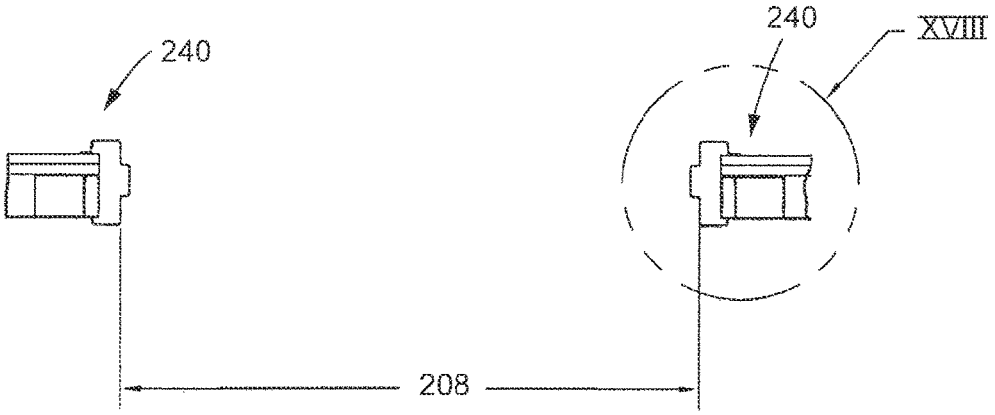
FIG. 17 is a partial, plan view, in transverse section, of the door opening of the modular storage structure of FIG. 13.
Figure 18:
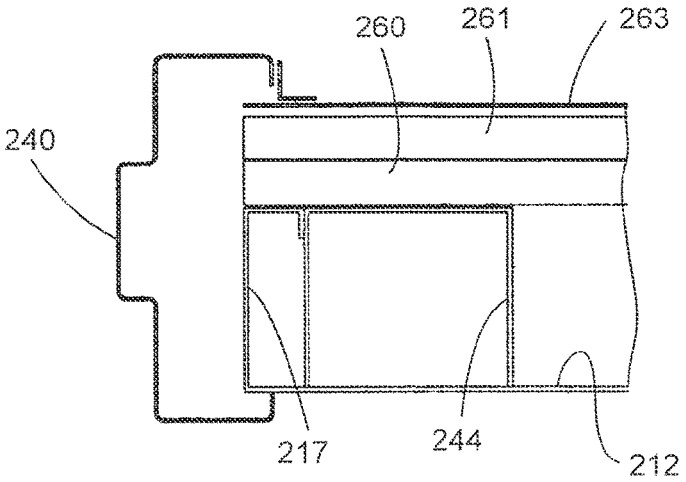
FIG. 18 is an enlarged detail view taken from FIG. 17, as indicated by circle XVIII in FIG. 17, illustrating the door frame of the modular storage structure of FIG. 13.

FIGS. 17 and 18 show a top view of the door opening 208 and a close-up view of the intersection between the door frame 240, the wall panel 212, the stiffener 244, a plurality of wallboard layers 260, and the interior skin 262. As shown, in FIG. 18, the wall interlock member 216 can engage with the stiffener 244 to provide support to the door frame 240 and the wallboard layers 260.

Figure 19:
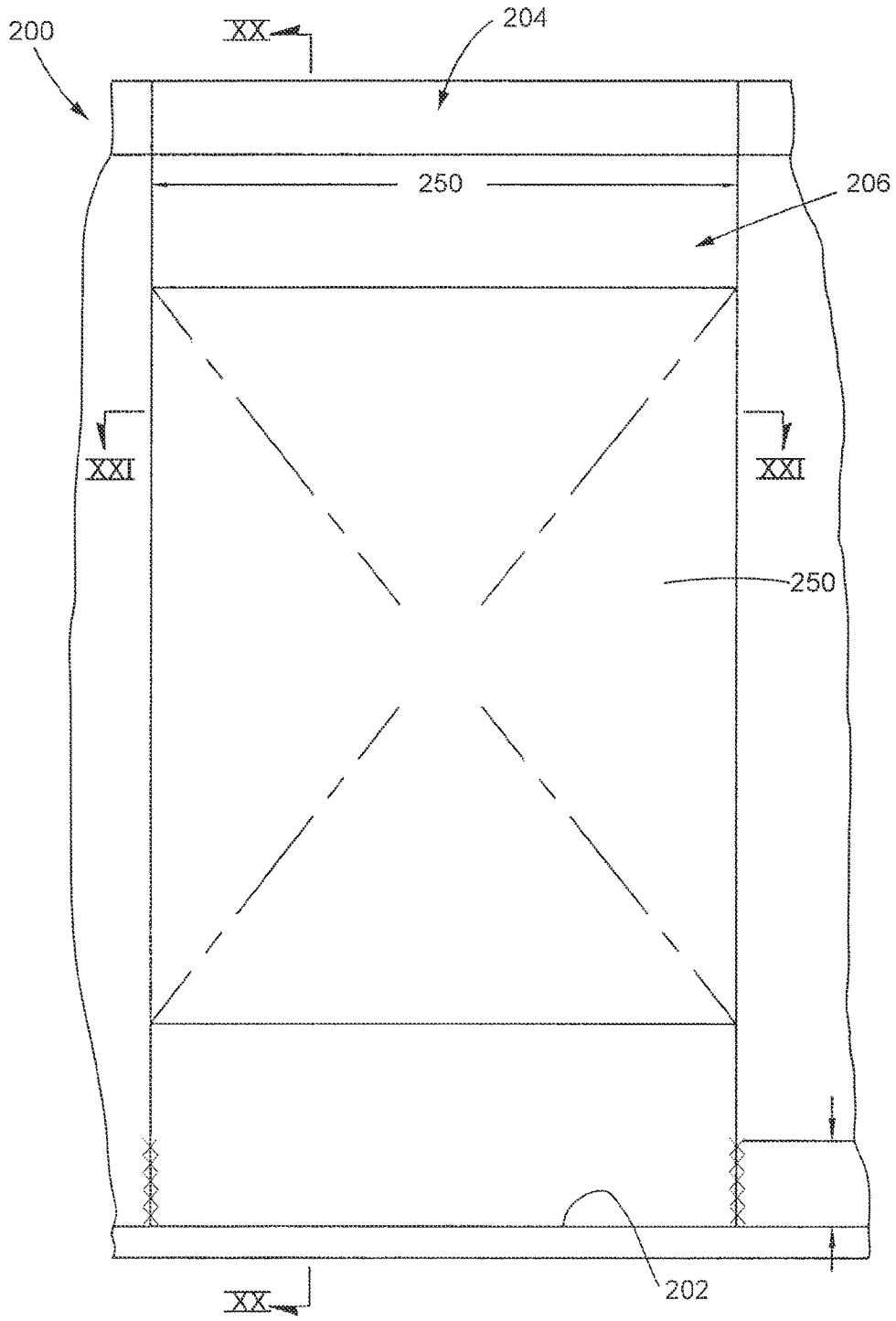
FIG. 19 is a partial, rear elevational view of the modular storage structure of FIG. 13, illustrating an explosion relief panel opening.
Figure 20:
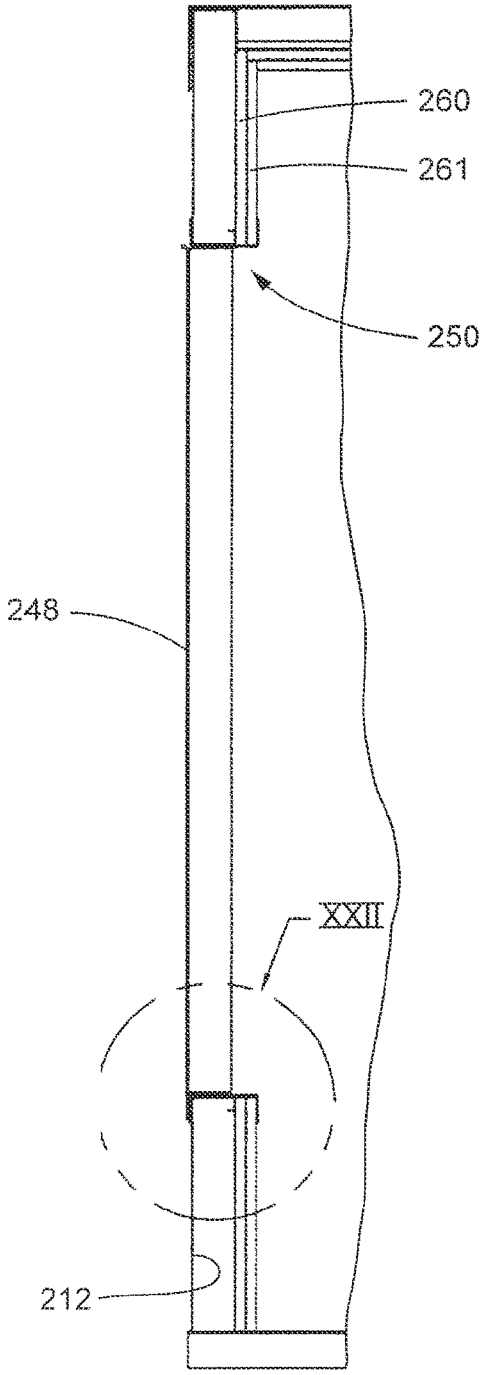
FIG. 20 is a cross-sectional view, taken along line XX-XX in FIG. 19, of the explosion relief panel opening of the modular storage structure of FIG. 13, illustrating an explosion relief panel pivotally mounted within the explosion relief panel opening.
Figure 21:
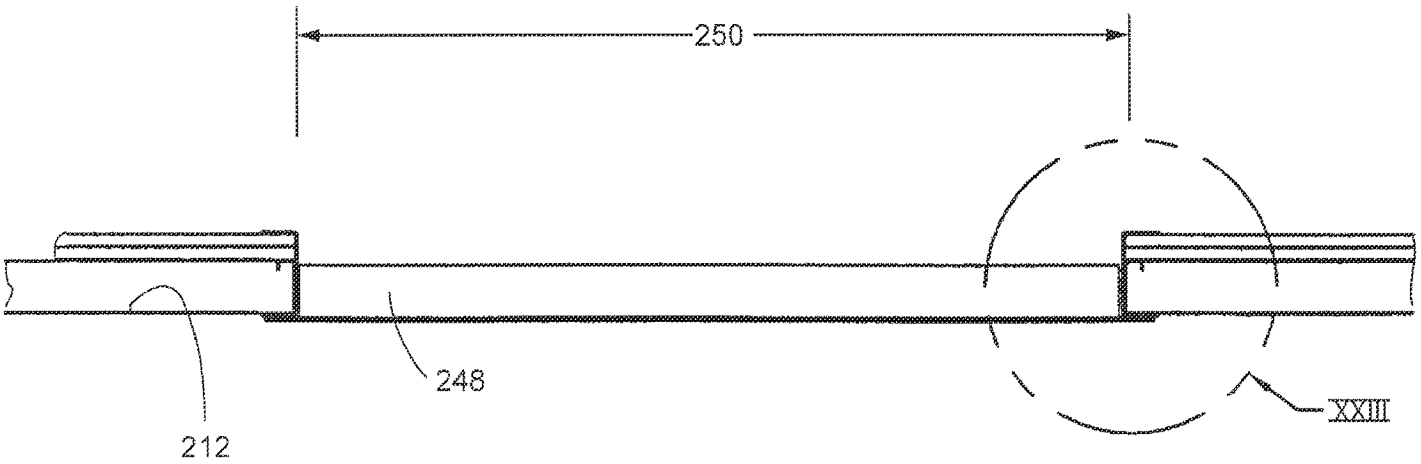
FIG. 21 is a cross-sectional view, taken along line XXI-XXI in FIG. 19, of the explosion relief panel opening of the modular storage structure of FIG. 13.

FIGS. 19-21 show portions of the wall system 206 of the modular storage structure 200 including an explosion relief panel 248. FIG. 19 shows a rear view of the modular storage structure 200 with an explosion relief panel opening 250 formed in the wall system 206. FIG. 20 shows a side sectional view of the explosion relief panel 248 installed into the explosion relief panel opening 250. The explosion relief panel opening 250 is formed between wall panels 212 and wallboard layers 260 surrounding the opening and engaging the wall panels. FIG. 21 shows a top sectional view of the explosion relief panel 248 installed into the explosion relief panel opening 250.

Figure 22:
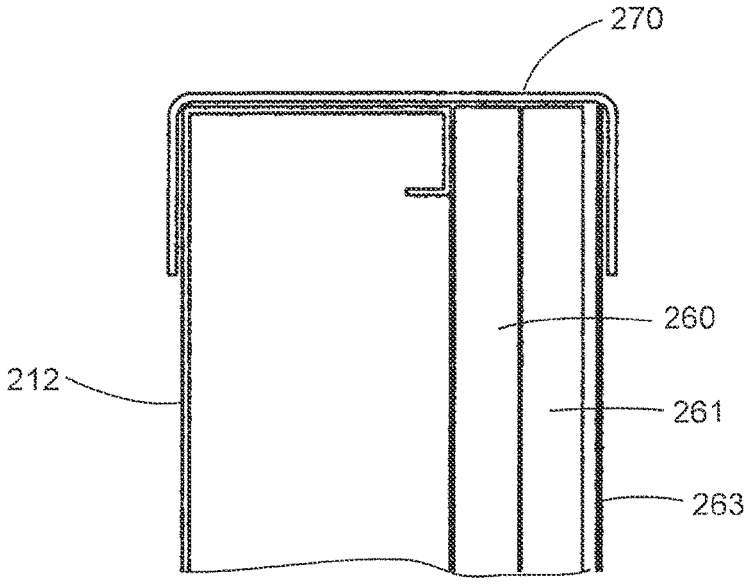
FIG. 22 is an enlarged detail view taken from FIG. 20, as indicated by circle XXII in FIG. 20, illustrating an explosion relief panel frame of the modular storage structure of FIG. 13.
Figure 23:
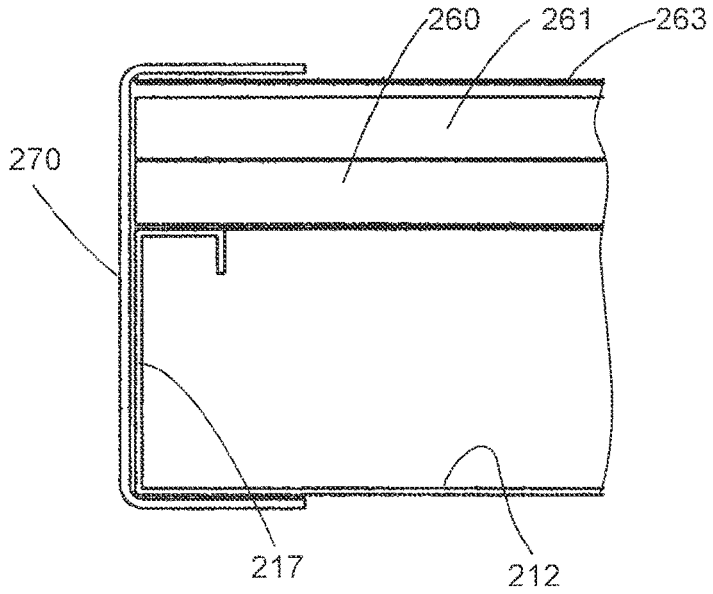
FIG. 23 is an enlarged detail view taken from FIG. 21, as indicated by circle XXIII in FIG. 21, illustrating the explosion relief panel frame of the modular storage structure of FIG. 13.

FIG. 22 shows a close-up view of a lower edge of the explosion relief panel opening 250 that includes a wall panel 212, a two wallboard layers 260 engaging the wall panel, and a formed channel 270 that separates the explosion relief panel 248. FIG. 23 shows a close-up view of a side edge of the explosion relief panel opening 250.

The modular storage structure 200 of FIGS. 13-23 can be similar in other respects to the modular storage structure 100 of FIGS. 1-12. The roof 204 and the wall system 206 of the modular storage structure 200 of FIGS. 13-23 are similar in other respects to the roof 104 and the wall system 106 of the modular storage structure 100 of FIGS. 1-12.

FIGS. 24-35 illustrate another embodiment of a modular storage structure 300. The modular storage structure 300 of FIGS. 24-35 satisfies at least the four-hour fire rating standards according to the criteria of FM Approval Standard 6409 and ASTM E119-15.

Figure 24A:
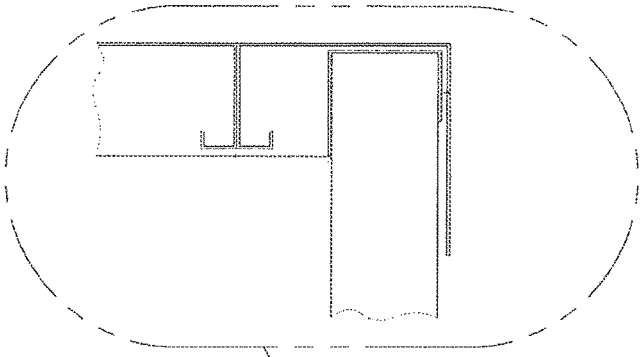
FIG. 24A is an enlarged, detail view taken from FIG. 24, as indicated by the circle therein.
Figure 24:
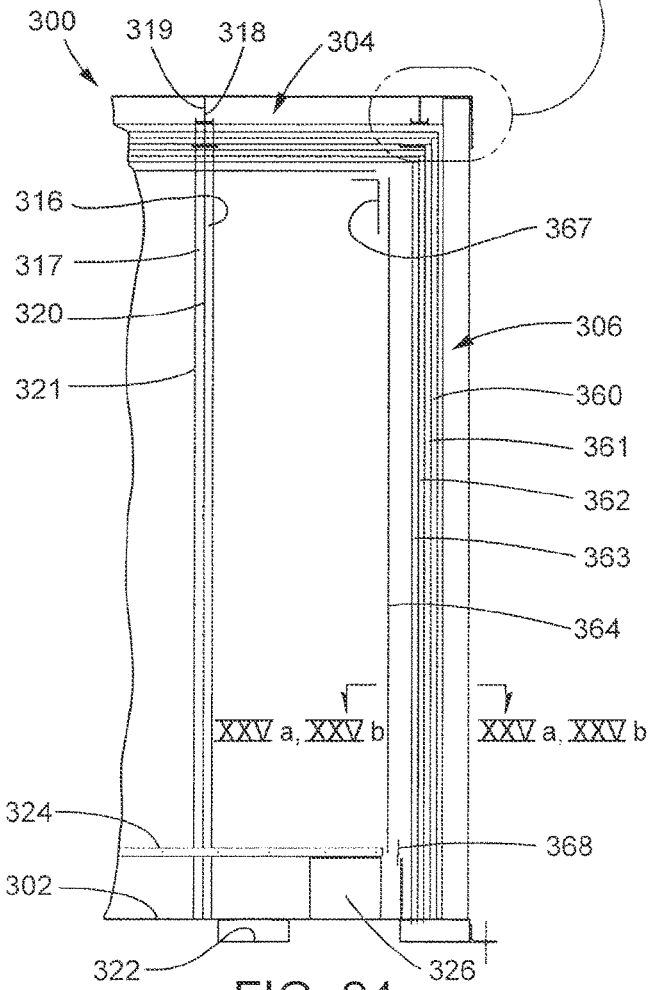
FIG. 24 is a partial, interior wall corner elevational view, in longitudinal section, of another embodiment of a modular storage structure constructed according to principles of the present disclosure.

FIG. 24 shows the modular storage structure 300 including a floor 302, a roof 304, and wall system 306. In some embodiments, a door can be installed on the structure 300 to at least partially and selectively occlude a door opening 308. FIG. 24 also shows a detailed view of the roof 304 and the roof s intersection with the wall system 306. The roof 304 includes roof panels 310, and the wall system 306 includes wall panels 312 which are constructed and function in a manner similar to that described above in connection with the storage structure 100 of FIGS. 1-12. A wall track 314 can engage upper ends of the wall panels 312 adjacent the roof panels 310.

The storage structure 300 is constructed to satisfy the "fire-rated" construction standard set forth in FM Approval Standard 6049. In the illustrated embodiment, the storage structure 300 is constructed as at least a 4-hour fire-rated storage structure. In embodiments, the wall system 306 of the modular storage structure 300 is effective to inhibit the transmission of heat through the wall system 306 such that the wall system 306 meets at least the four-hour unidirectional fire-rating standards according to the specifications of ASTM E119-15 and/or FM Approval Standard 6049. In embodiments, the roof 304 of the modular storage structure 300 is effective to inhibit the transmission of heat through the roof 304 such that the roof 304 meets at least the three-hour fire-rating standards according to the specifications of ASTM E119-15 and/or FM Approval Standard 6049.

The storage structure 300 is constructed to withstand a 90 mph (40 m/sec) wind load applying a 32 $lb/ft^2$ (1.6 kPa) inward and −42 $lb/ft^2$ (2.1 kPa) outward wind pressure on the structure 300 according to the specifications of FM Approval Standard 6049. The roof 304 of the storage structure 300 is designed to withstand a combined roof (live and snow) load of 40 $lb/ft^2$ (195 $kg/m^2$) according to the specifications of FM Approval Standard 6049. The floor 302 is constructed to provide a load capacity of at least 250 $lb/ft^2$ (1220 $kg/m^2$) under dry conditions according to the specifications of FM Approval Standard 6049.

FIG. 24 shows a partial front view an interior rear corner of the modular storage structure 300 including a plurality of wall panels 312 and roof panels 310. In such embodiments, the wall panels 312 are flat sheets that terminate at edges having J-shaped wall interlock members 316. Similarly, the roof panels 310 can have edges terminating in J-shaped roof interlock members 318. FIG. 24 shows two roof panels 310 meeting at their respective roof interlock members 318, and two wall panels 312 meeting at respective wall interlock members 316 to form a panel seam 320 and a stud 321. The embodiment in FIG. 24 also shows a forklift pocket 322 for forklift access, as well as a grating 324 supported by a grating support 326. IN embodiments, the four-hour fire-rated storage structure 300 includes at least one layer of wallboard 360 made from gypsum or other suitable material, and an interior skin 364. In the illustrated embodiment, the wall system 306 includes four layers of gypsum wallboard 360, 361, 362, 363. The interior of the storage structure 300 can also include ceiling flashing 367 and sump flashing 368. The layers of gypsum wallboard panels 360, 361, 362, 363 can be mounted and finished in a manner as described above in connection with the first and second wallboard layers 260, 261 of the modular storage structure 200 of FIGS. 13-23.

Figure 25B:
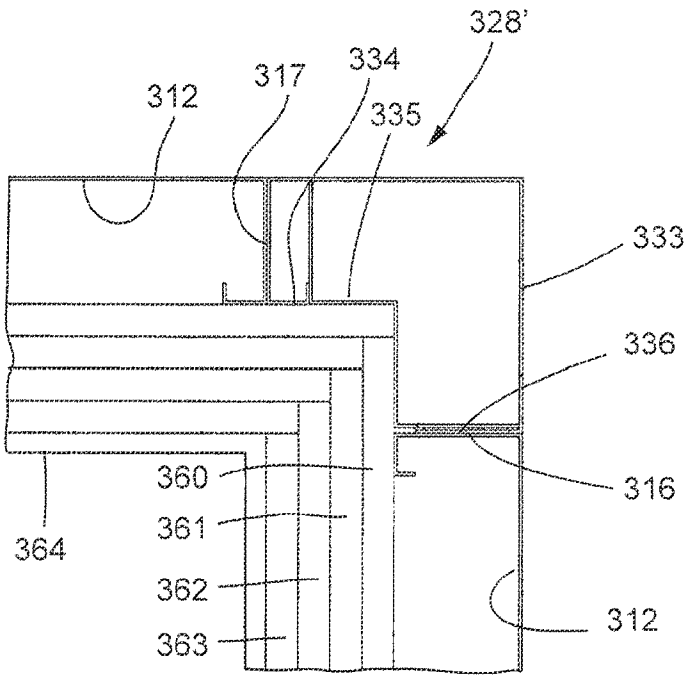
FIG. 25B is a cross-sectional view, taken along line XXVb-XXVb in FIG. 24, of another embodiment of a wall corner suitable for use with the modular storage structure of FIG. 24.
Figure 25A:
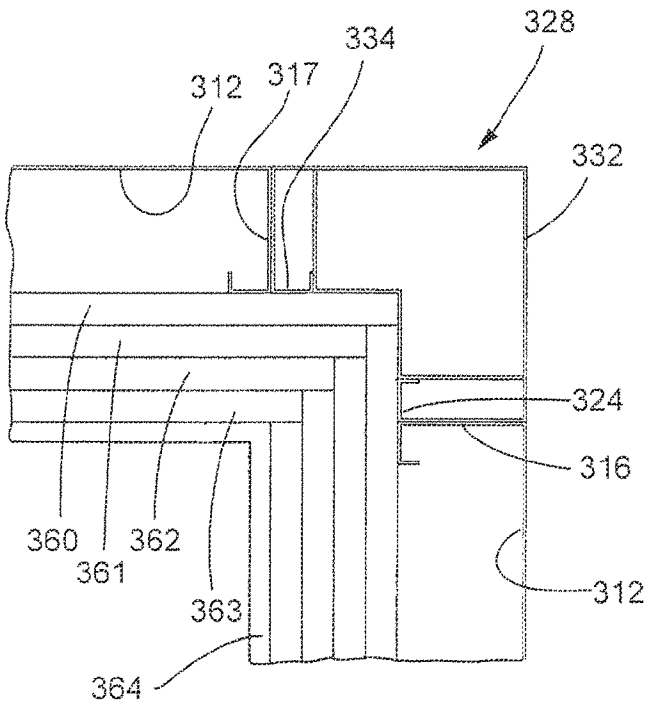
FIG. 25A is a cross-sectional view, taken along line XXVa-XXVa in FIG. 24, of the wall corner of the modular storage structure of FIG. 24.
Figure 26:
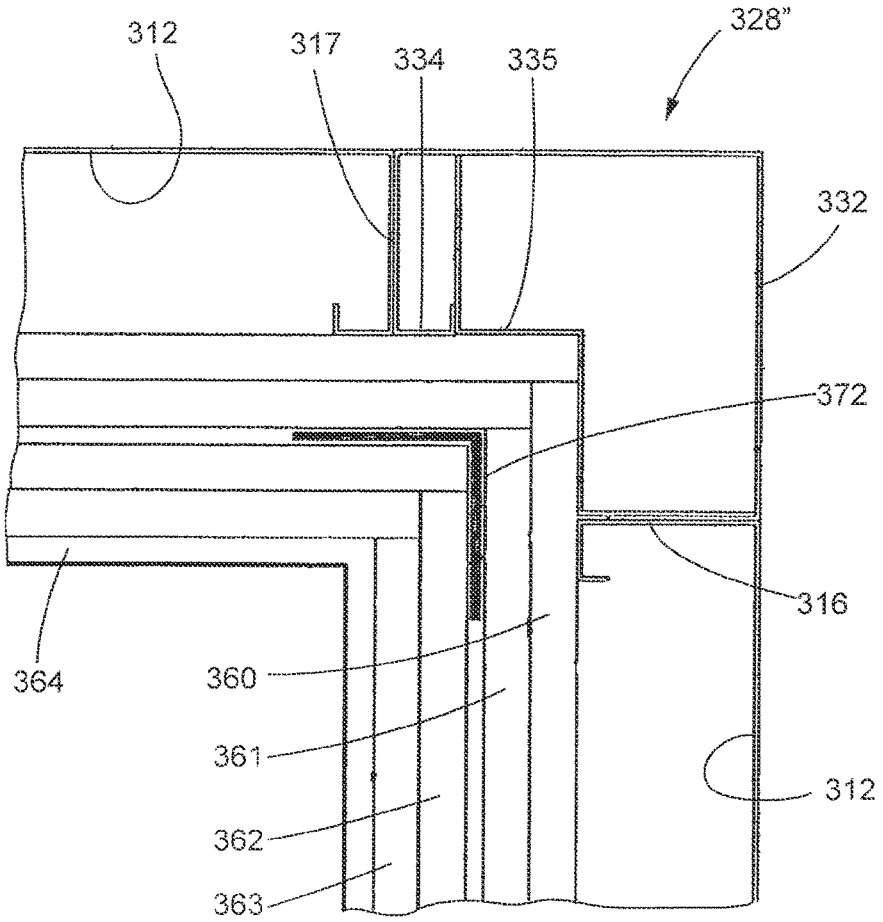
FIG. 26 is a view, as in FIG. 25B, of the wall corner of the modular storage structure of FIG. 24, illustrating an angle bracket interposed between a second and third layer of drywall boards.

FIGS. 25A and 25B show top sectional views of embodiments of the rear corner 328 of the modular storage structure 300. The rear corner 328 is formed where two wall panels 312 meet and are joined by a corner panel. FIG. 25A shows a corner wall panel 332 having two J-shaped corner interlock members 334 that engage the wall interlock members 316 of adjacent wall panels 312. An alternative embodiment of a corner wall panel 333 is shown in FIG. 25B having one J-shaped corner interlock member 334 and one flat corner interlock member 336. Corner insert 335 can engage with the corner wall panels 332, 333 providing structural support and support for the layers of wallboard 360 disposed against the wall panels 312. FIG. 26 shows another embodiment of the rear corner 328 that includes a corner support bracket 372 embedded between at least some of the wallboard layers to provide additional support.

Figure 27:
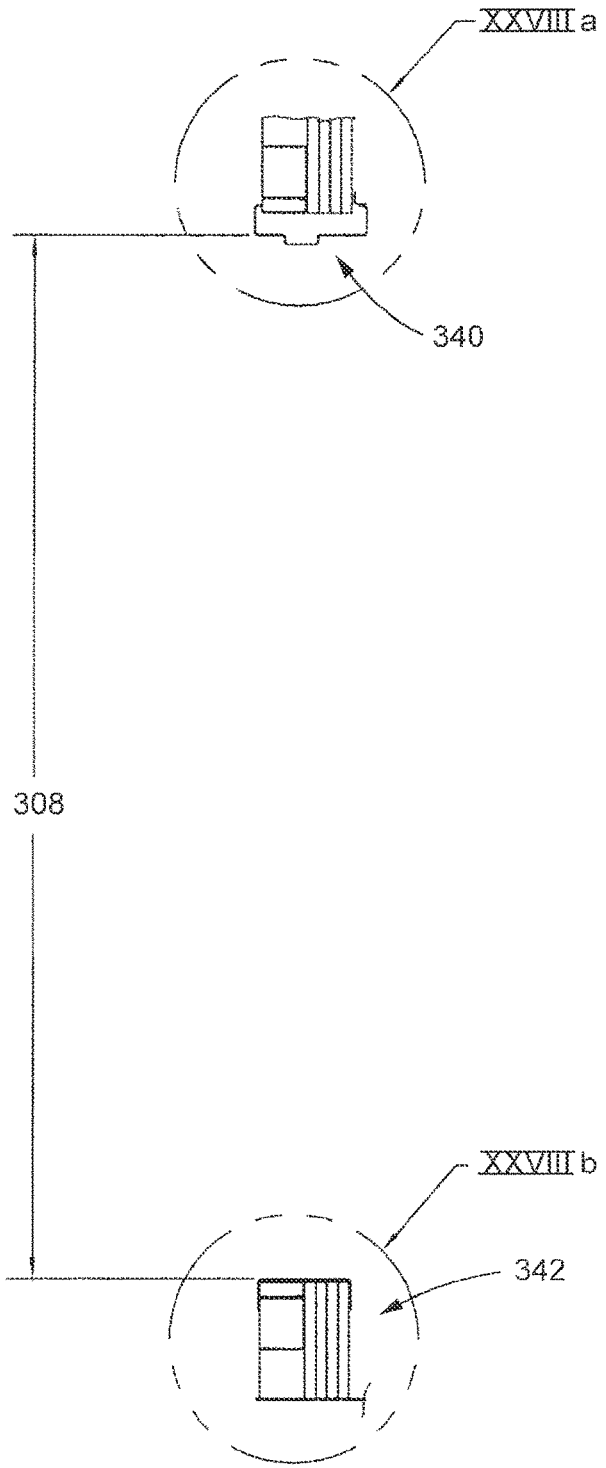
FIG. 27 is a partial, side view, in longitudinal section, of a door opening of the modular storage structure of FIG. 24.
Figure 28A:
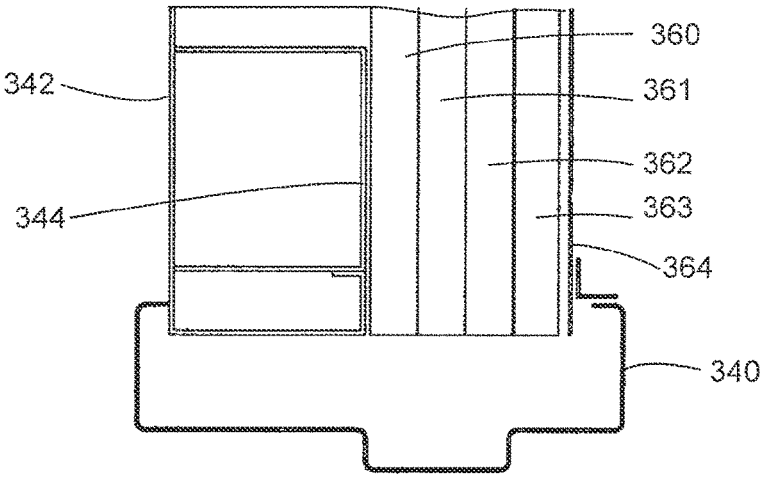
FIG. 28A is an enlarged detail view taken from FIG. 27, as indicated by circle XXVIIIa in FIG. 27, illustrating a door frame of the modular storage structure of FIG. 24.
Figure 28B:
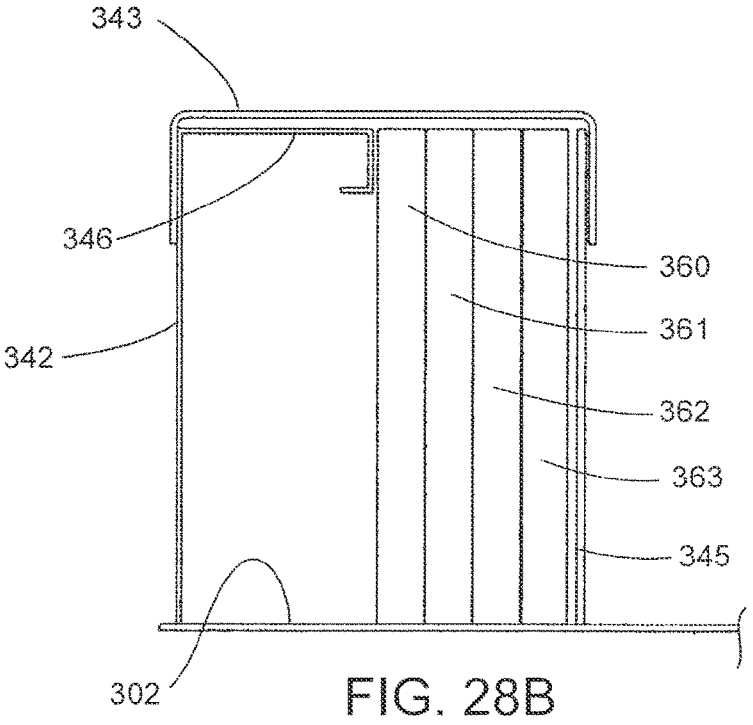
FIG. 28B is an enlarged detail view taken from FIG. 27, as indicated by circle XXVIIIb in FIG. 27, illustrating a door threshold of the modular storage structure of FIG. 24.
Figure 29:
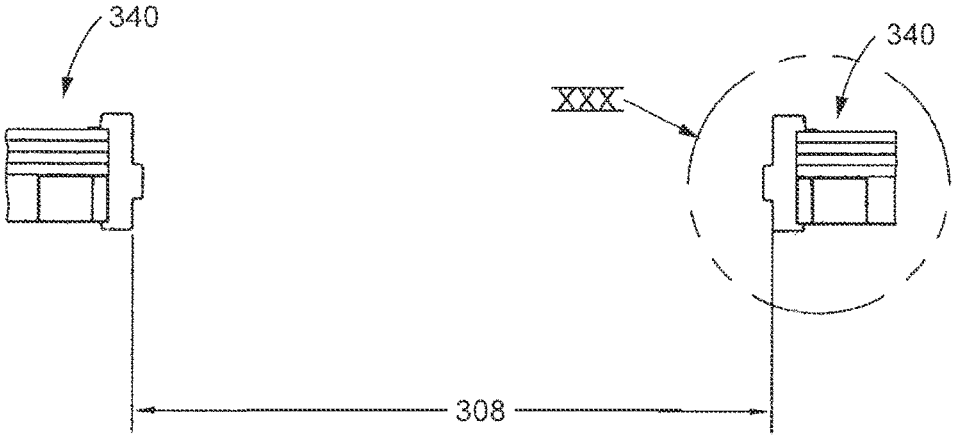
FIG. 29 is a partial, plan view, in transverse section, of the door opening of the modular storage structure of FIG. 24.
Figure 30:
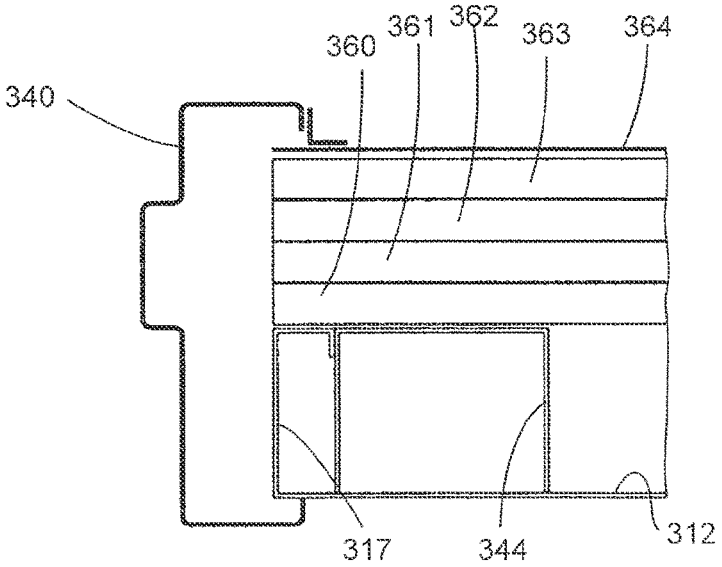
FIG. 30 is an enlarged detail view taken from FIG. 29, as indicated by circle XXX in FIG. 29, illustrating the door frame of the modular storage structure of FIG. 24.

FIGS. 27, 28A, and 28B show side sectional views of an embodiment of the door opening 308 and accompanying door frame 340 and door threshold 342. In such embodiments, the door frame 340 can engage with a header 342 and a stiffener 344. FIG. 28A further shows four wallboard layers 360 and an interior skin 362, where the door frame 340 separates the door opening 308. As shown in FIG. 28B, the threshold 342 can be connected to the floor 302 of the modular storage structure 300 and can have a J-shaped threshold interlock member 346. A formed channel 343 can cover the threshold 342, a plurality of wallboard layers 360, and a sump skirt 345, separating from the door opening 308. FIGS. 29 and 30 show a top view of the door opening 308 and a close-up view of the intersection between the door frame 340, the wall panel 312, the stiffener 344, a plurality of wallboard layers 360, and the interior skin 362. As shown, in FIG. 30, the wall interlock member 316 can engage with the stiffener 344 to provide support to the door frame 340 and the wallboard layers 360.

Figure 31:
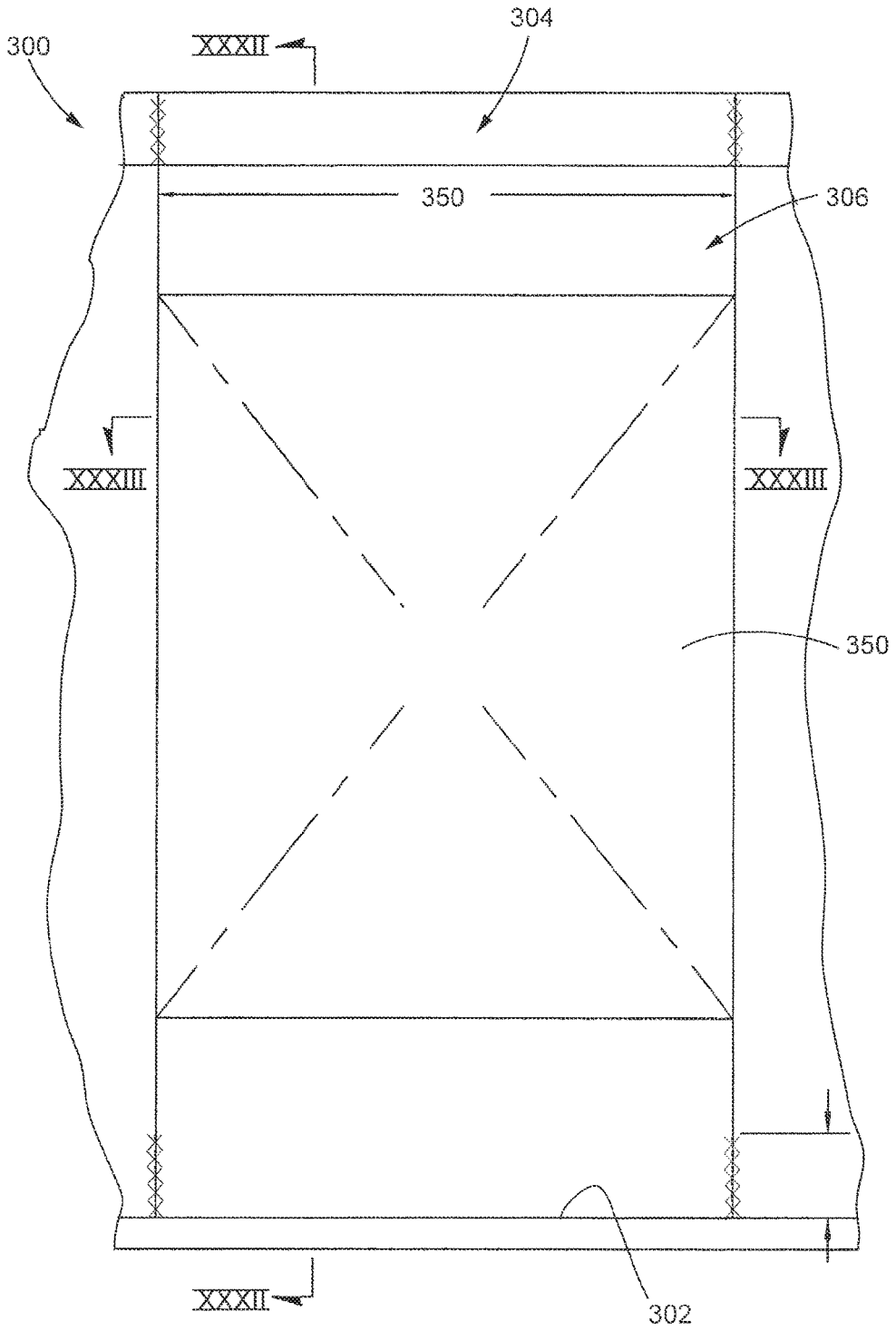
FIG. 31 is a partial, rear elevational view of the modular storage structure of FIG. 24, illustrating an explosion relief panel opening.
Figure 32:
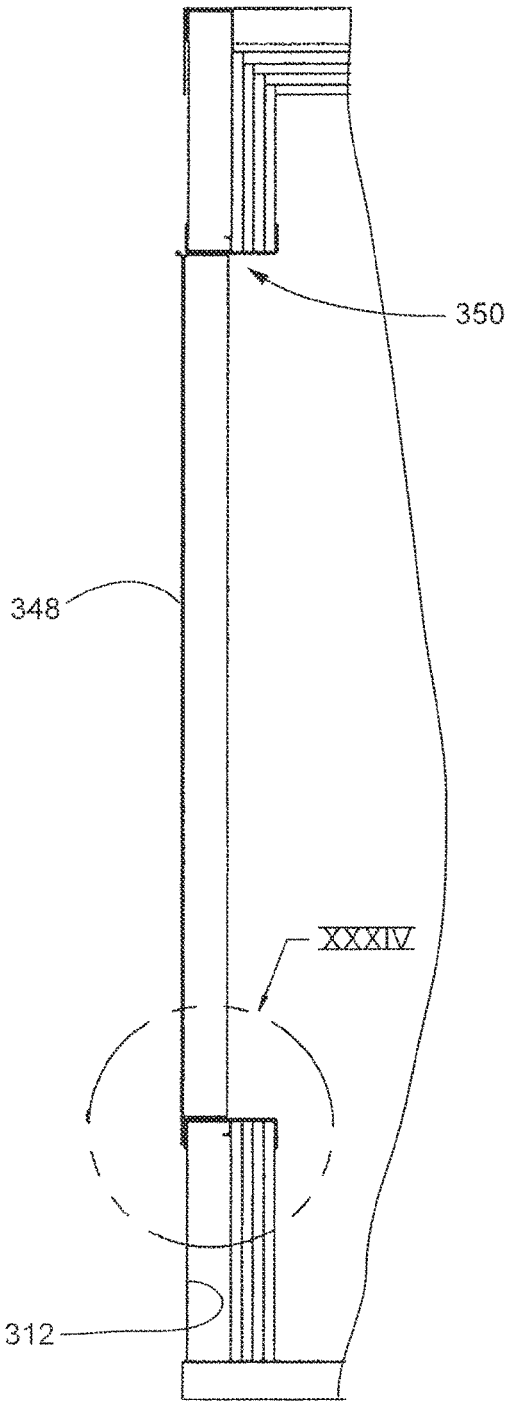
FIG. 32 is a cross-sectional view, taken along line XXXII-XXII in FIG. 31, of the explosion relief panel opening of the modular storage structure of FIG. 24, illustrating an explosion relief panel pivotally mounted within the explosion relief panel opening.
Figure 33:
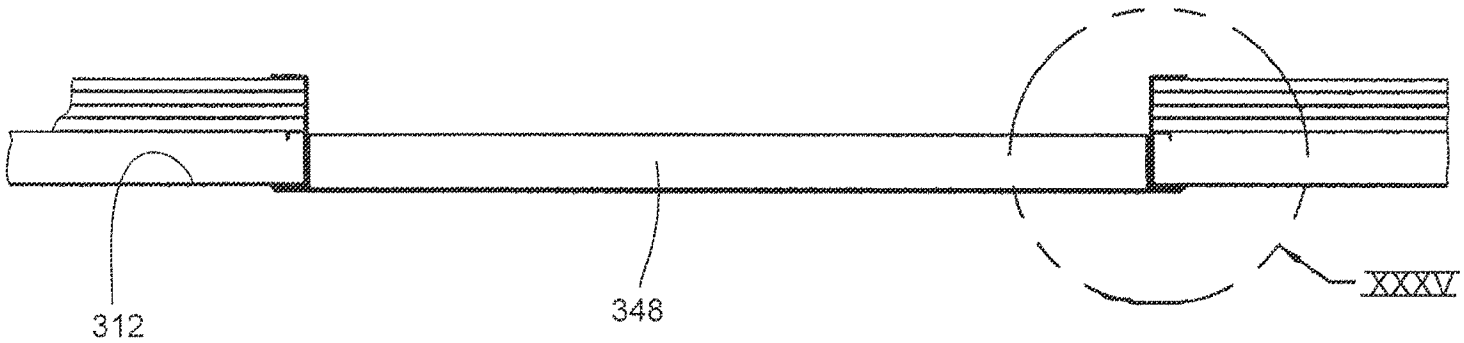
FIG. 33 is a cross-sectional view, taken along line XXIII-XXXIII in FIG. 31, of the explosion relief panel opening of the modular storage structure of FIG. 24.
Figure 34:
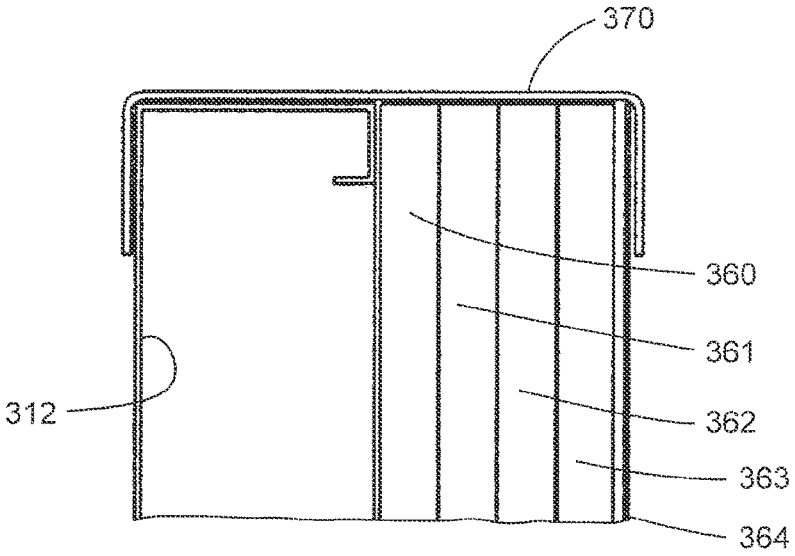
FIG. 34 is an enlarged detail view taken from FIG. 32, as indicated by circle XXXIV in FIG. 32, illustrating an explosion relief panel frame of the modular storage structure of FIG. 24.
Figure 35:
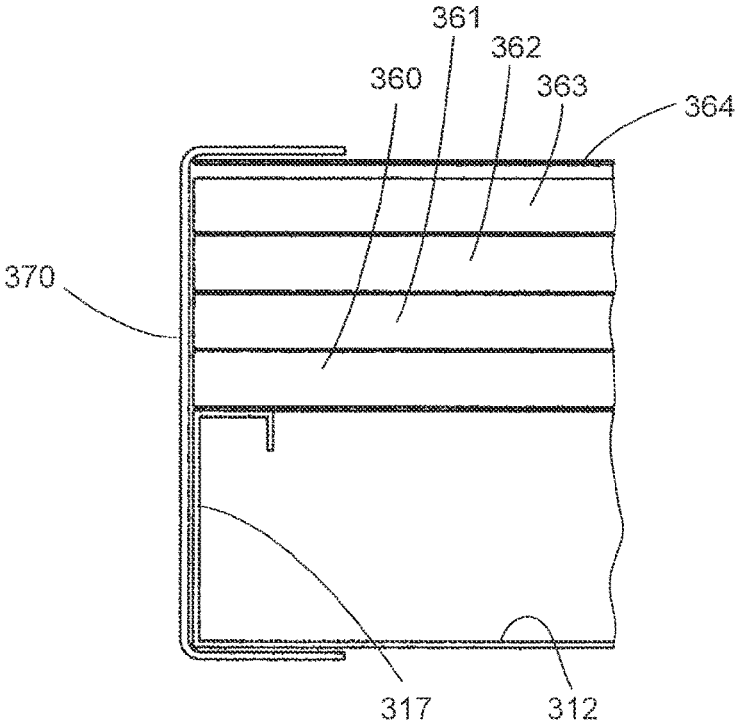
FIG. 35 is an enlarged detail view taken from FIG. 33, as indicated by circle XXXV in FIG. 33, illustrating the explosion relief panel frame of the modular storage structure of FIG. 24.

FIGS. 31-33 show portions of the wall system 306 of the modular storage structure 300 including an explosion relief panel 348. FIG. 31 shows a rear view of the modular storage structure 300 with an explosion relief panel opening 350 formed in the wall system 306. FIG. 32 shows a side sectional view of the explosion relief panel 348 installed into the explosion relief panel opening 350. The explosion relief panel opening 350 is formed between wall panels 312 and wallboard layers 360 surrounding the opening and engaging the wall panels. FIG. 33 shows a top sectional view of the explosion relief panel 348 installed into the explosion relief panel opening 350. FIG. 34 shows a close-up view of a lower edge of the explosion relief panel opening 350 that includes a wall panel 312, a four wallboard layers 360 engaging the wall panel, and a formed channel 370 that separates the explosion relief panel 348. FIG. 35 shows a close-up view of a side edge of the explosion relief panel opening 350.

The modular storage structure 300 of FIGS. 24-35 can be similar in other respects to the modular storage structure 200 of FIGS. 13-23 and to the modular storage structure 100 of FIGS. 1-12. The roof 204 and the wall system 206 of the modular storage structure 200 of FIGS. 13-23 are similar in other respects to the roof 104 and the wall system 106 of the modular storage structure 100 of FIGS. 1-12.

FIGS. 36-43 illustrate another embodiment of a modular storage structure 400 constructed according to principles of the present disclosure. The modular storage structure 400 of FIGS. 36-39 satisfies at least the two-hour fire rating standards according to the criteria of FM Approval Standard 6409 and ASTM E119-15. In embodiments, the modular storage structure 400 of FIGS. 36-39 includes substantially the same construction details of the floor 202, the roof, 204, and the wall system 206 of the modular storage structure 200 of FIGS. 13-23.

Figure 36:
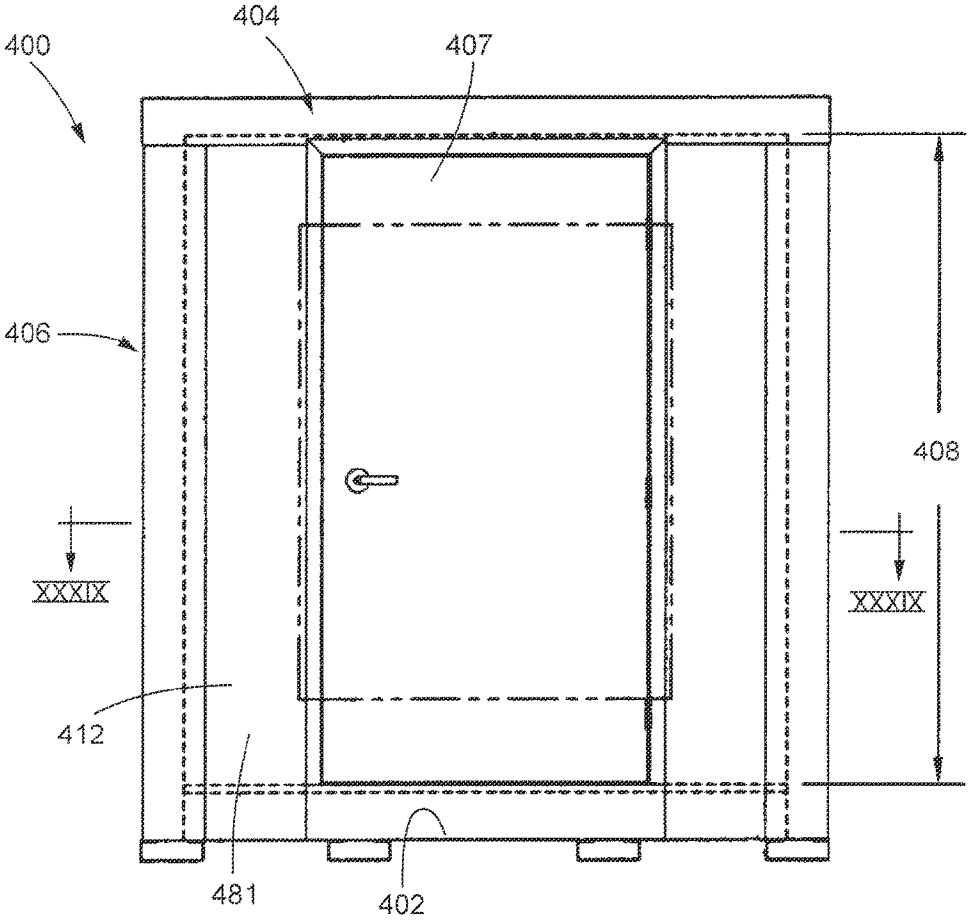
FIG. 36 is a front elevational view of another embodiment of a modular storage structure constructed according to principles of the present disclosure.

Referring to FIG. 36, the modular storage structure 400 includes a floor 402, a roof 404, and a wall system 406. A door 407 is installed on the structure 400 to selectively occlude a door opening 408. The roof 404 includes roof panels 410 (see FIGS. 42 and 43), and the wall system 406 includes wall panels 412 which are constructed and function in a manner similar to the roof panels 110 and the wall panels 112 described above in connection with the storage structure 100 of FIGS. 1-12.

The storage structure 400 is constructed to satisfy the "fire-rated" construction standard set forth in FM Approval Standard 6049. In the illustrated embodiment, the storage structure 400 is constructed as at least a 2-hour fire-rated storage structure. The storage structure 400 is constructed to withstand at least a 90 mph (40 m/sec) wind load applying a 32 $lb/ft^2$ (1.6 kPa) inward and −42 $lb/ft^2$ (2.1 kPa) outward wind pressure on the structure 400 according to the specifications of FM Approval Standard 6049. The roof 404 of the storage structure 200 is designed to withstand at least a combined roof (live and snow) load of 40 $lb/ft^2$ (195 $kg/m^2$) according to the specifications of FM Approval Standard 6049. The floor 402 is constructed to provide a load capacity of at least 250 $lb/ft^2$ (1220 $kg/m^2$) under dry conditions according to the specifications of FM Approval Standard 6049.

In embodiments, the modular storage structure 400 of FIG. 36 complies with the National Fire Protection Association (NFPA) Flammable and Combustible Liquids Code 30, the NFPA 1 Fire Code, and applicable Environmental Protection Agency (EPA) Regulations. In embodiments, the modular storage structure 400 can be constructed to be suitable for indoor use.

Figure 39:
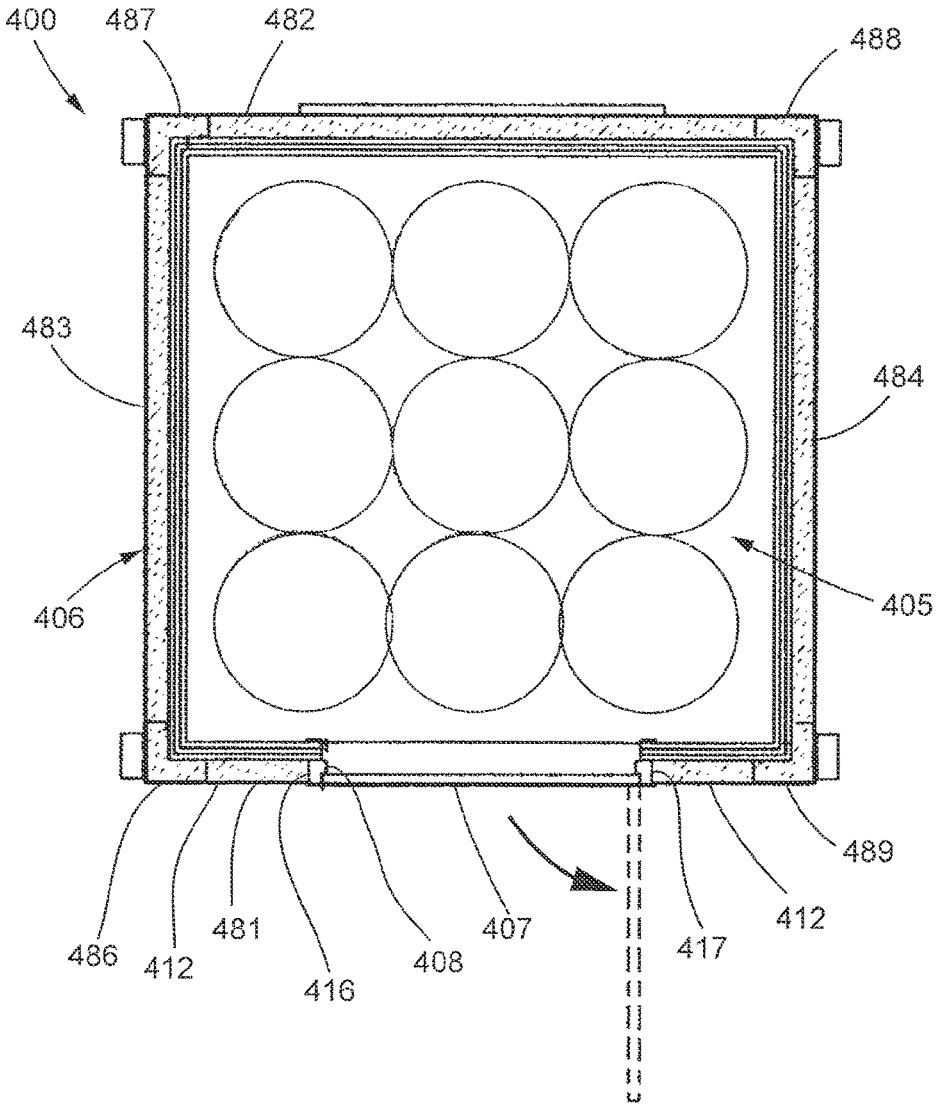
FIG. 39 is a cross-sectional view, taken along line XXXIX-XXXIX in FIG. 36, of the modular storage structure of FIG. 36.

Referring to FIG. 39, the wall system 406 includes a front portion 481, a rear portion 482, a left side portion 483, and a right side portion 484 each comprising at least one wall panel 412. The wall system 406 further includes first, second, third, and fourth corner wall panels 486, 487, 488, 489. The first corner wall panel 486 engages the front portion 481 and the left side portion 483. The second corner wall panel 487 engages the left side portion 483 and the rear portion 482. The third corner wall panel 488 engages the rear portion 482 and the right side portion 488. The fourth corner wall panel 489 engages the right side portion 484 and the front portion 481. The door opening 408 is formed between the interlock members 416, 417 of two wall panels 412 of the front portion 481. The door opening 408 is configured to allow entrance access to the interior storage area 405.

Figure 37:
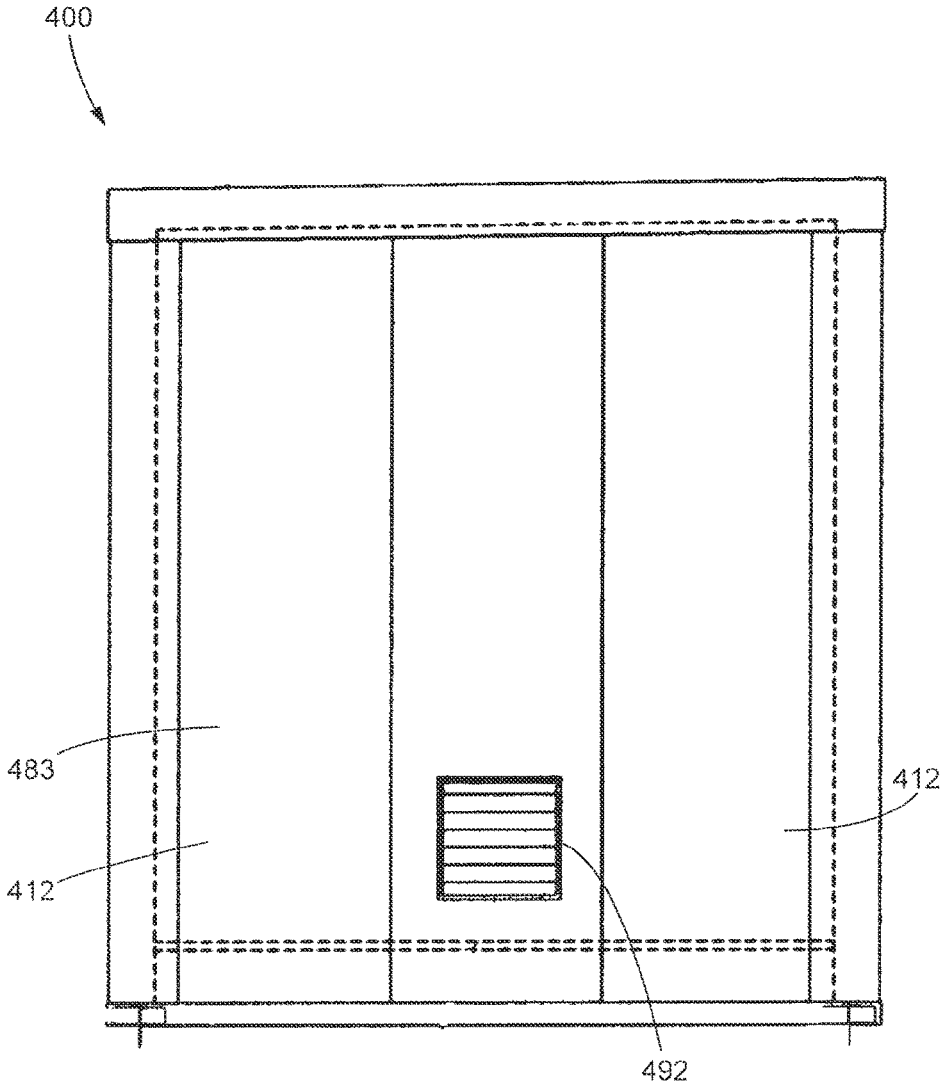
FIG. 37 is a left elevational view of the modular storage structure of FIG. 36.
Figure 38:
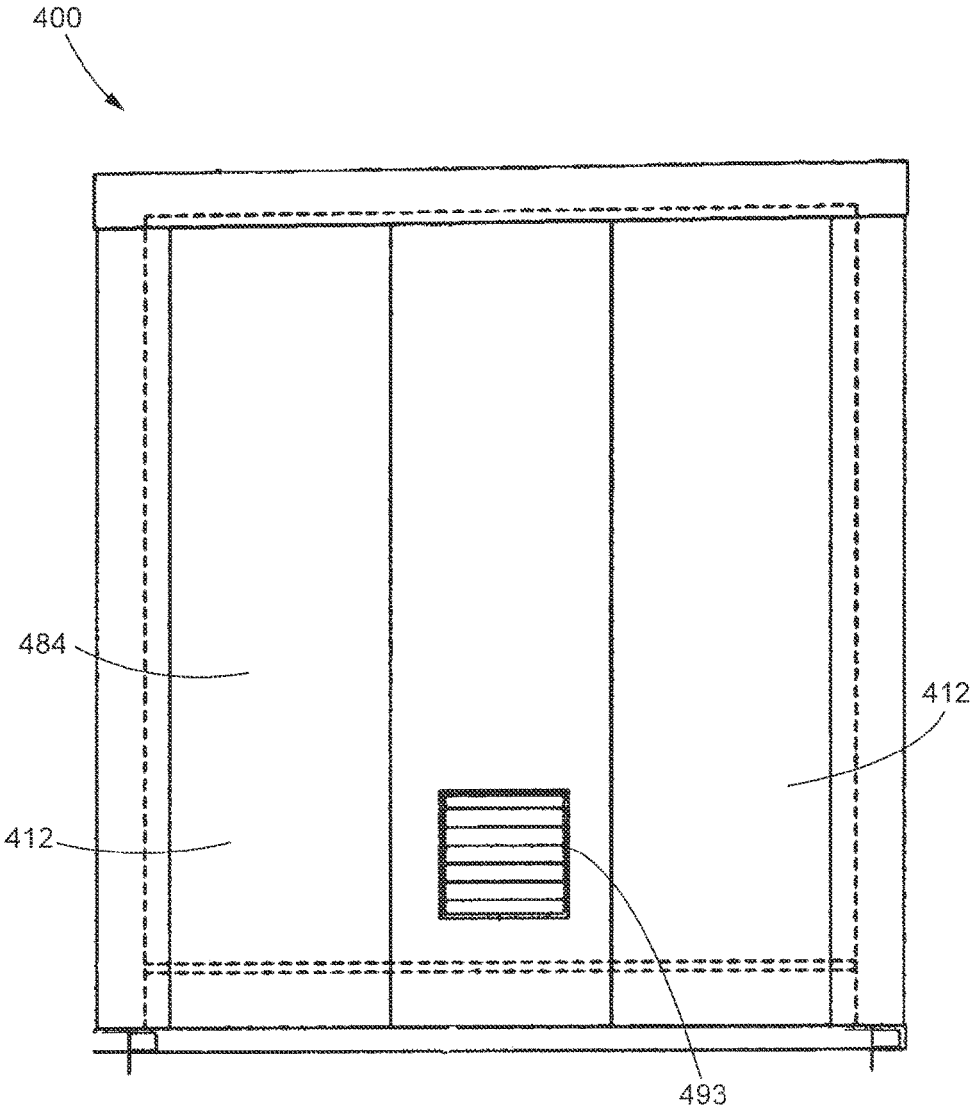
FIG. 38 is a right elevational view of the modular storage structure of FIG. 36.

Referring to FIGS. 37 and 38, the left side portion 483 and the right side portion 484 can each be equipped with a gravity air flow vents 492, 493, respectively. In embodiments, a fire damper with fusible links can be provided in the vents.

Figure 40:
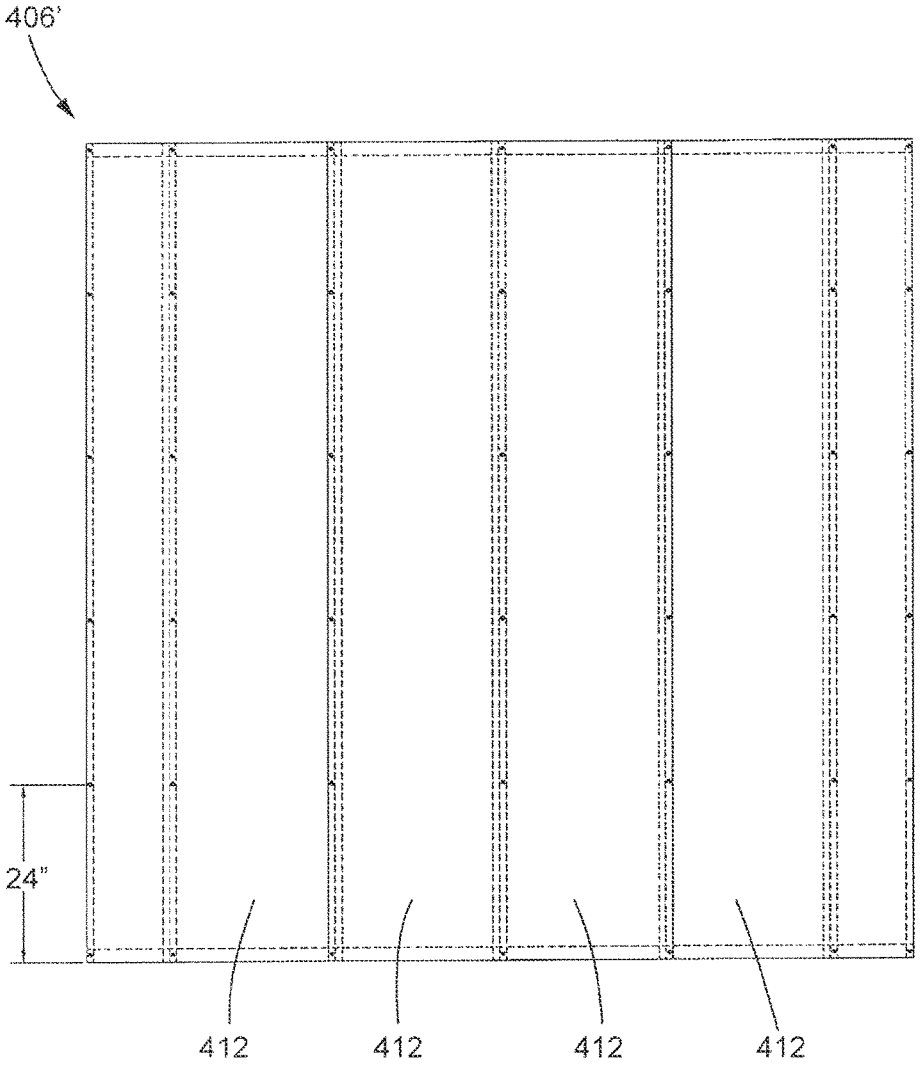
FIG. 40 is an elevational view of a wall assembly suitable for use in the modular storage structure of FIG. 36.
Figure 41:
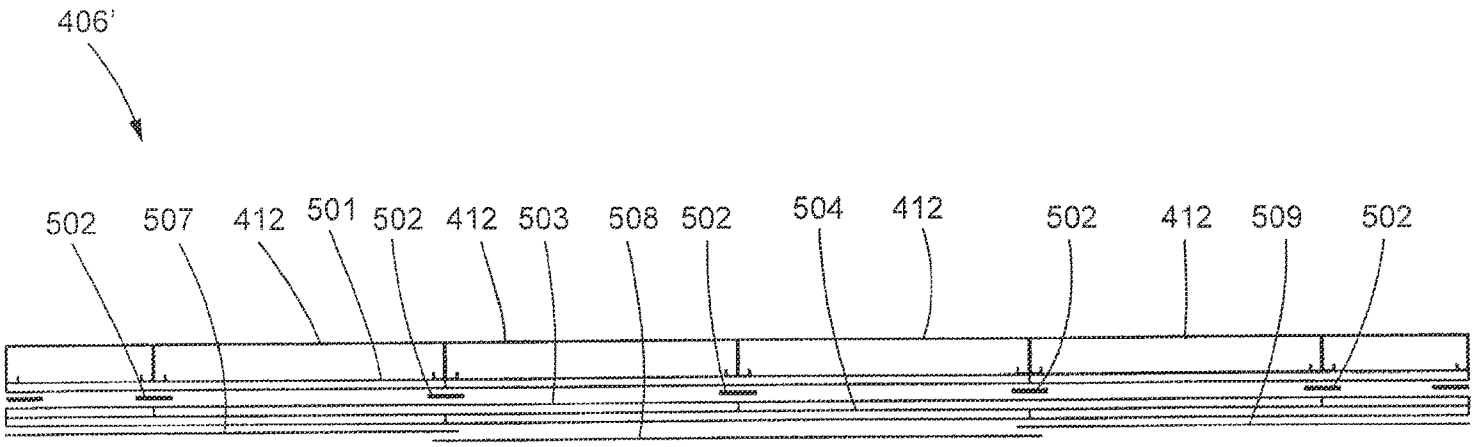
FIG. 41 is an exploded plan view of the wall assembly of FIG. 40.

FIGS. 40 and 41 show construction details of a wall assembly 406' suitable for use in the wall system 406. In embodiments, the wall system 406 of the modular storage structure 400 is effective to inhibit the transmission of heat through the wall system 406 such that the wall system 406 meets at least the two-hour uni-directional fire-rating standards according to the specifications of ASTM E119-15 and/or FM Approval Standard 6049. The wall assembly 406' includes a plurality of wall panels 412. Referring to FIG. 41, a first gypsum wallboard layer 501 of panels is fastened to the wall panels 412. Stripping 502 in the form of flat sheet metal strips is applies at each panel seam. The stripping 502 runs from the upper ends to the lower ends of the wall panels 412. Second and third gypsum wallboard layers 503, 504 are applied thereafter. All joints are staggered. Then, cold rolled flat sheet steel 507, 508, 509 is adhered and fastened to the inner surface of the third gypsum wallboard layer 504 in an overlapping manner.

Figure 42:
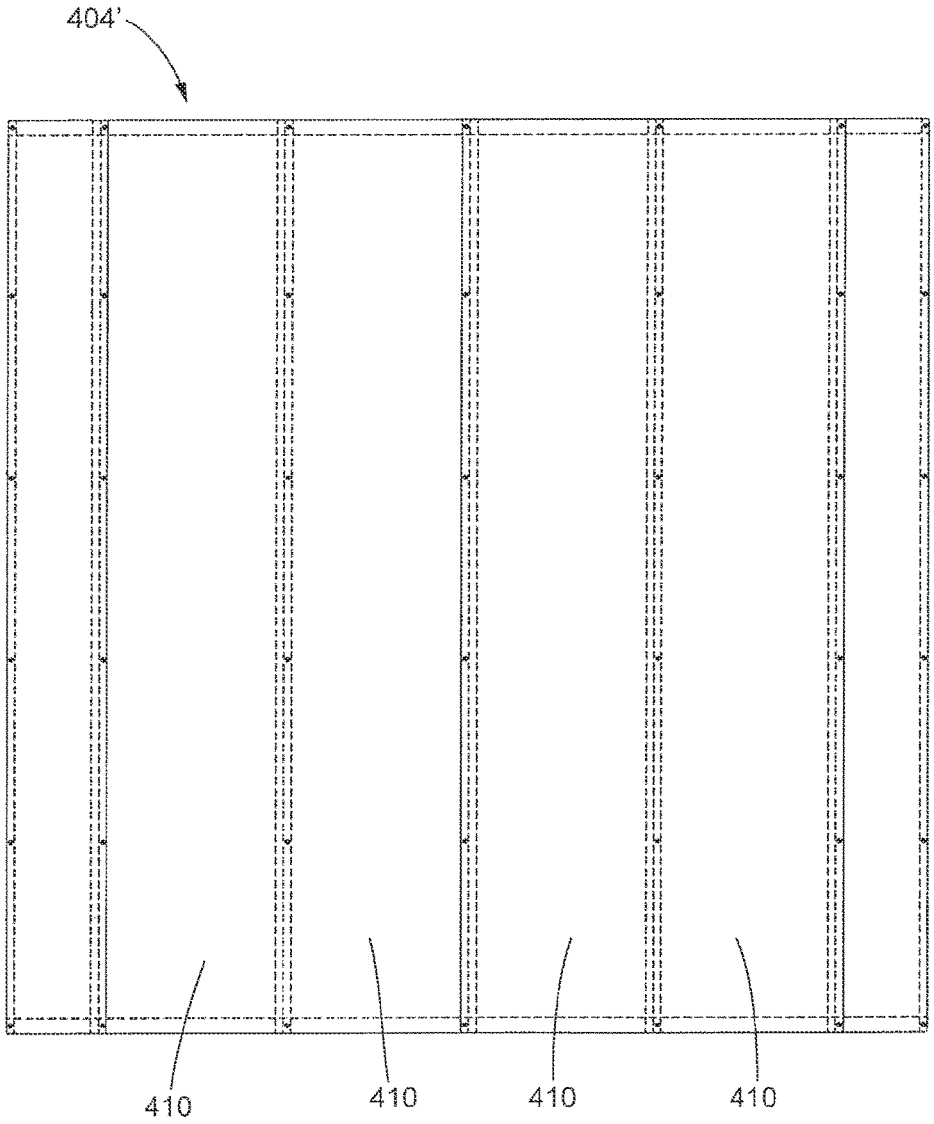
FIG. 42 is a plan view of a roof assembly suitable for use in the modular storage structure of FIG. 36.
Figure 43:
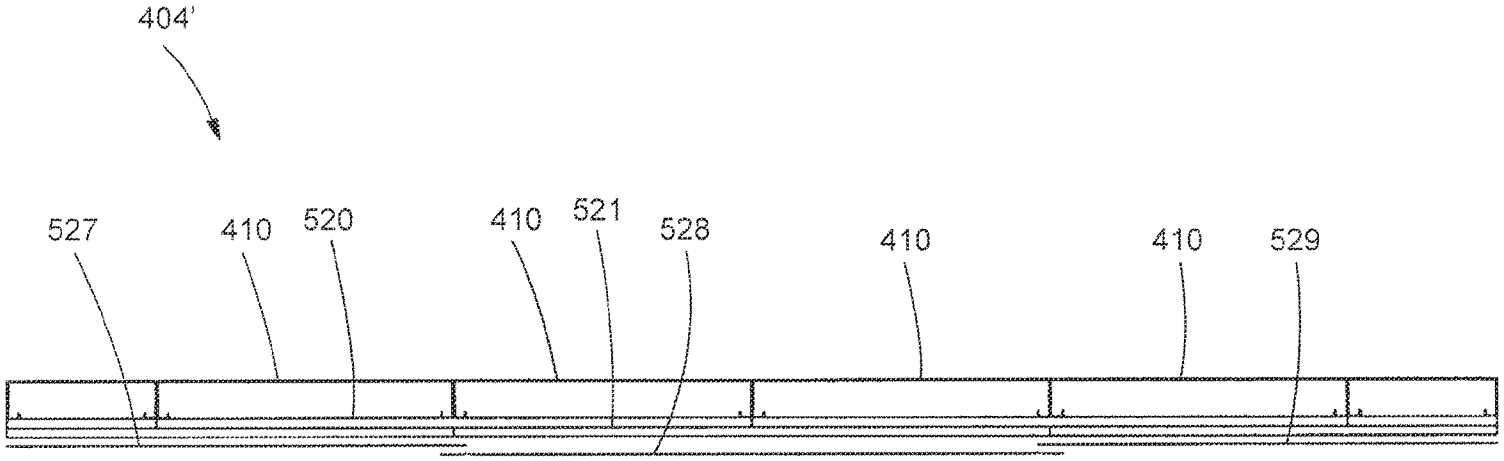
FIG. 43 is an exploded elevational view of the roof assembly of FIG. 42.

FIGS. 42 and 43 show construction details of a roof assembly 404' suitable for use in the roof 404. In embodiments, the roof 404 of the modular storage structure 400 is effective to inhibit the transmission of heat through the roof 404 such that the roof 404 meets at least the one and one-half hour fire-rating standards according to the specifications of ASTM E119-15 and/or FM Approval Standard 6049.

The roof assembly 404' includes a plurality of roof panels 410. Referring to FIG. 43, first and second gypsum wallboard layers 520, 521 of panels are fastened to the roof panels 410. All joints are staggered. Then, cold rolled flat sheet steel 527, 528, 529 is adhered and fastened to the inner surface of the third gypsum wallboard layer 504.

The modular storage structure 400 of FIGS. 36-43 can be similar in other respects to the modular storage structure 200 of FIGS. 13-23 and to the modular storage structure 100 of FIGS. 1-12. The roof 404 and the wall system 406 of the modular storage structure 400 of FIGS. 36-43 can be similar in other respects to the roof 104 and the wall system 106 of the modular storage structure 100 of FIGS. 1-12.

FIGS. 44-49 illustrate another embodiment of a modular storage structure 700 constructed according to principles of the present disclosure. The modular storage structure 700 of FIGS. 44-49 satisfies at least the four-hour fire rating standards according to the criteria of FM Approval Standard 6409 and ASTM E119-15. In embodiments, the modular storage structure 700 of FIGS. 36-39 includes substantially the same construction details of the floor 302, the roof, 304, and the wall system 306 of the modular storage structure 300 of FIGS. 24-35. In embodiments, the modular storage structure 700 of FIG. 44 complies with the National Fire Protection Association (NFPA) Flammable and Combustible Liquids Code 30, the NFPA 1 Fire Code, and applicable Environmental Protection Agency (EPA) Regulations.

Figure 44:
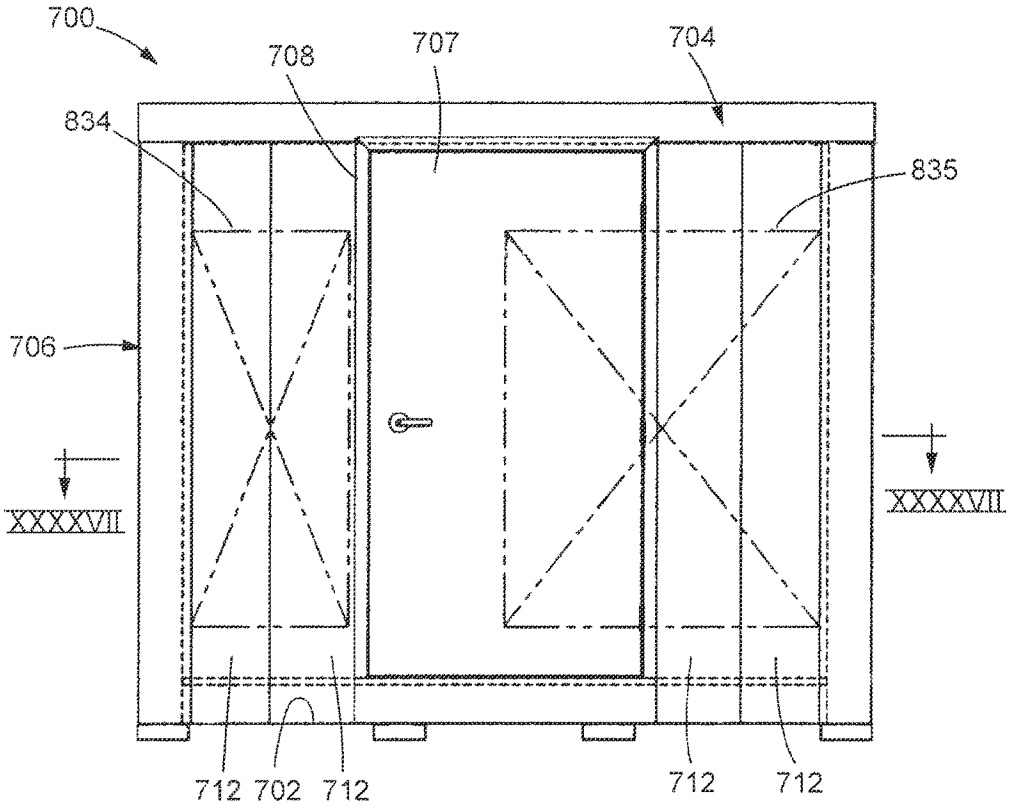
FIG. 44 is a front elevational view of another embodiment of a modular storage structure constructed according to principles of the present disclosure.

Referring to FIG. 44, the modular storage structure 700 includes a floor 702, a roof 704, and a wall system 706. A door 707 is installed on the structure 700 to selectively occlude a door opening 708. The roof 704 includes roof panels 710 (see FIG. 49), and the wall system 706 includes wall panels 712 which are constructed and function in a manner similar to the roof panels 110 and the wall panels 112 described above in connection with the storage structure 100 of FIGS. 1-12.

The storage structure 700 is constructed to satisfy the "fire-rated" construction standard set forth in FM Approval Standard 6049. In the illustrated embodiment, the storage structure 700 is constructed as at least a 4-hour fire-rated storage structure. In embodiments, the wall system 706 of the modular storage structure 700 is effective to inhibit the transmission of heat through the wall system 706 such that the wall system 706 meets at least the four-hour uni-directional fire-rating standards according to the specifications of ASTM E119-15 and/or FM Approval Standard 6049. In embodiments, the roof 704 of the modular storage structure 700 is effective to inhibit the transmission of heat through the roof 704 such that the roof 704 meets at least the three-hour fire-rating standards according to the specifications of ASTM E119-15 and/or FM Approval Standard 6049.

The storage structure 700 is constructed to withstand a 90 mph (40 m/sec) wind load applying a 32 lb/ft$^2$ (1.6 kPa) inward and −42 lb/ft$^2$ (2.1 kPa) outward wind pressure on the structure 700 according to the specifications of FM Approval Standard 6049. The roof 704 of the storage structure 700 is designed to withstand a combined roof (live and snow) load of 40 lb/ft$^2$ (195 kg/m$^2$) according to the specifications of FM Approval Standard 6049. The floor 702 is constructed to provide a load capacity of at least 250 lb/ft$^2$ (1220 kg/m$^2$) under dry conditions according to the specifications of FM Approval Standard 6049.

Referring to FIG. 39, the wall system 706 includes a front portion 781, a rear portion 782, a left side portion 783, and a right side portion 784 each comprising at least one wall panel 712. The wall system 706 further includes first, second, third, and fourth corner wall panels 786, 787, 788, 789. The first corner wall panel 786 the front portion 781 and the left side portion 783. The second corner wall panel 787 is connected to the left side portion 783 and the rear portion 782. The third corner wall panel 788 is connected to the rear portion 782 and the right side portion 784. The fourth corner wall panel 789 is connected to the right side portion 784 and the front portion 781. The rear portion 782 includes two ERPSs 831, 832 pivotally mounted to two ERP openings 834, 835, respectively, defined therein (see FIG. 44 also).

Figure 45:
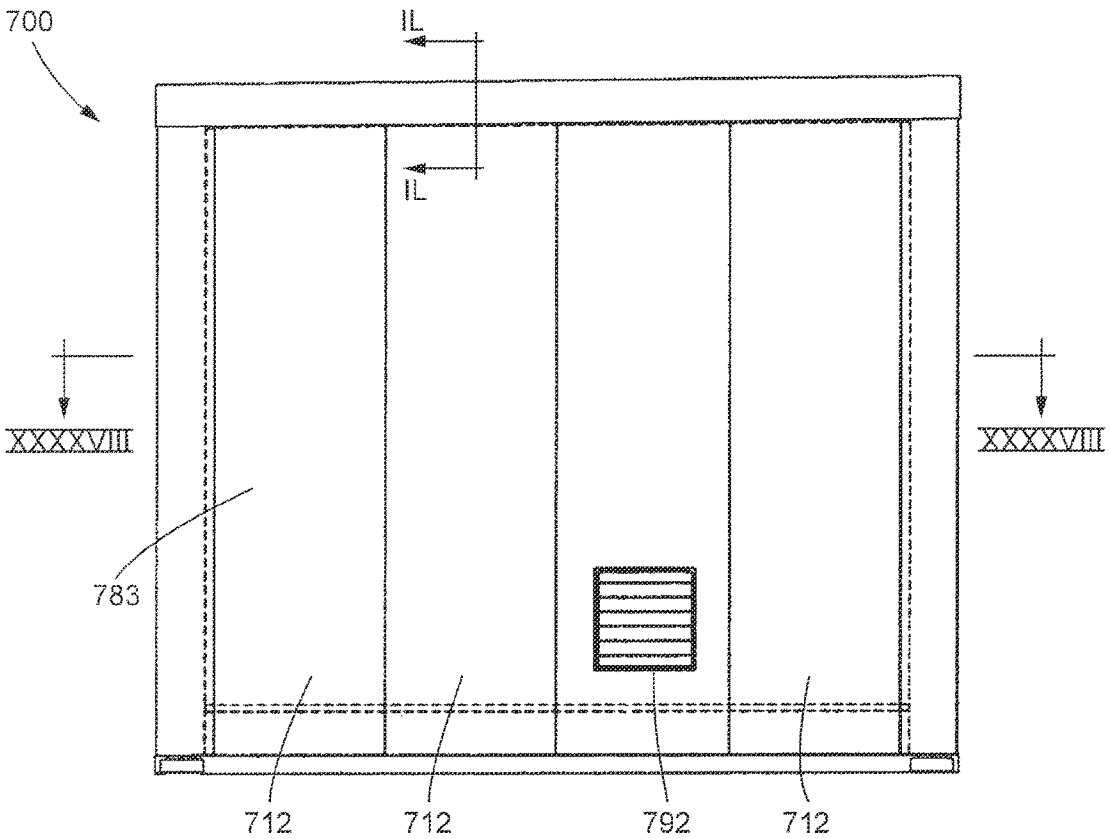
FIG. 45 is a left elevational view of the modular storage structure of FIG. 44.
Figure 46:
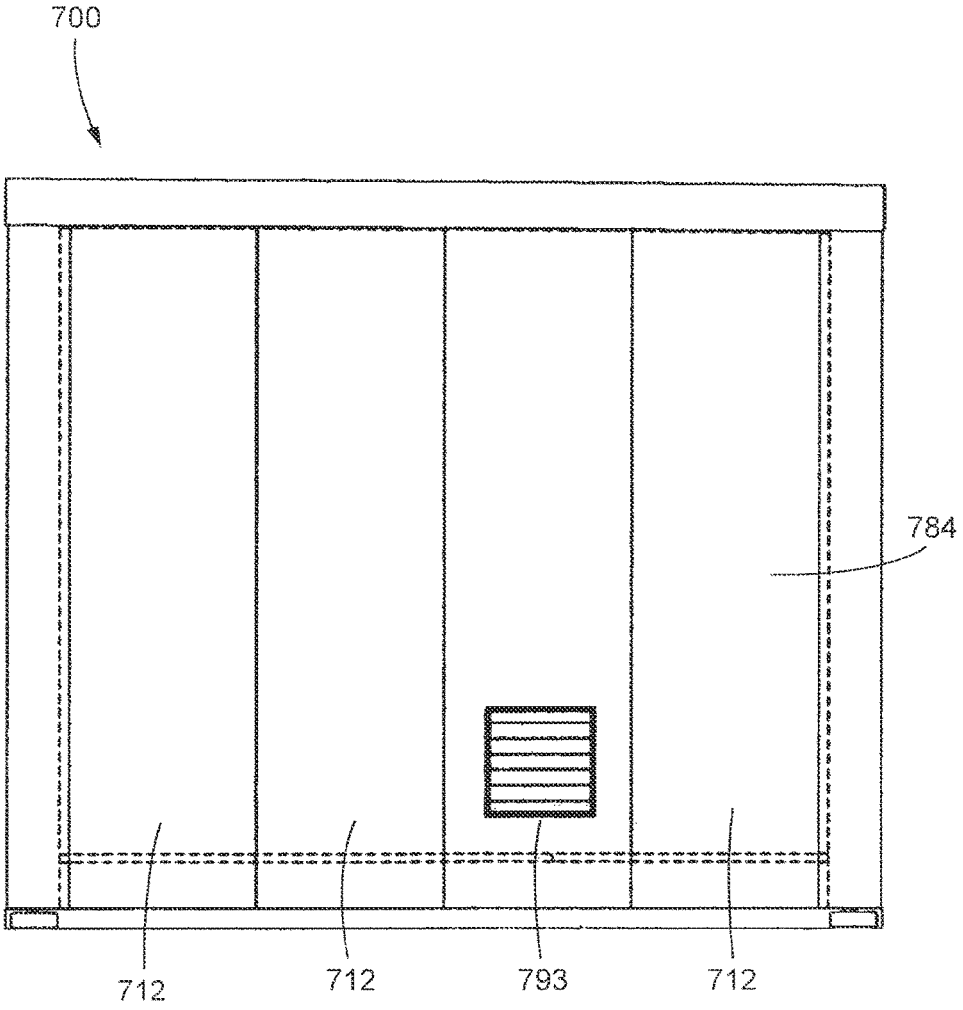
FIG. 46 is a right elevational view of the modular storage structure of FIG. 44.
Figure 47:
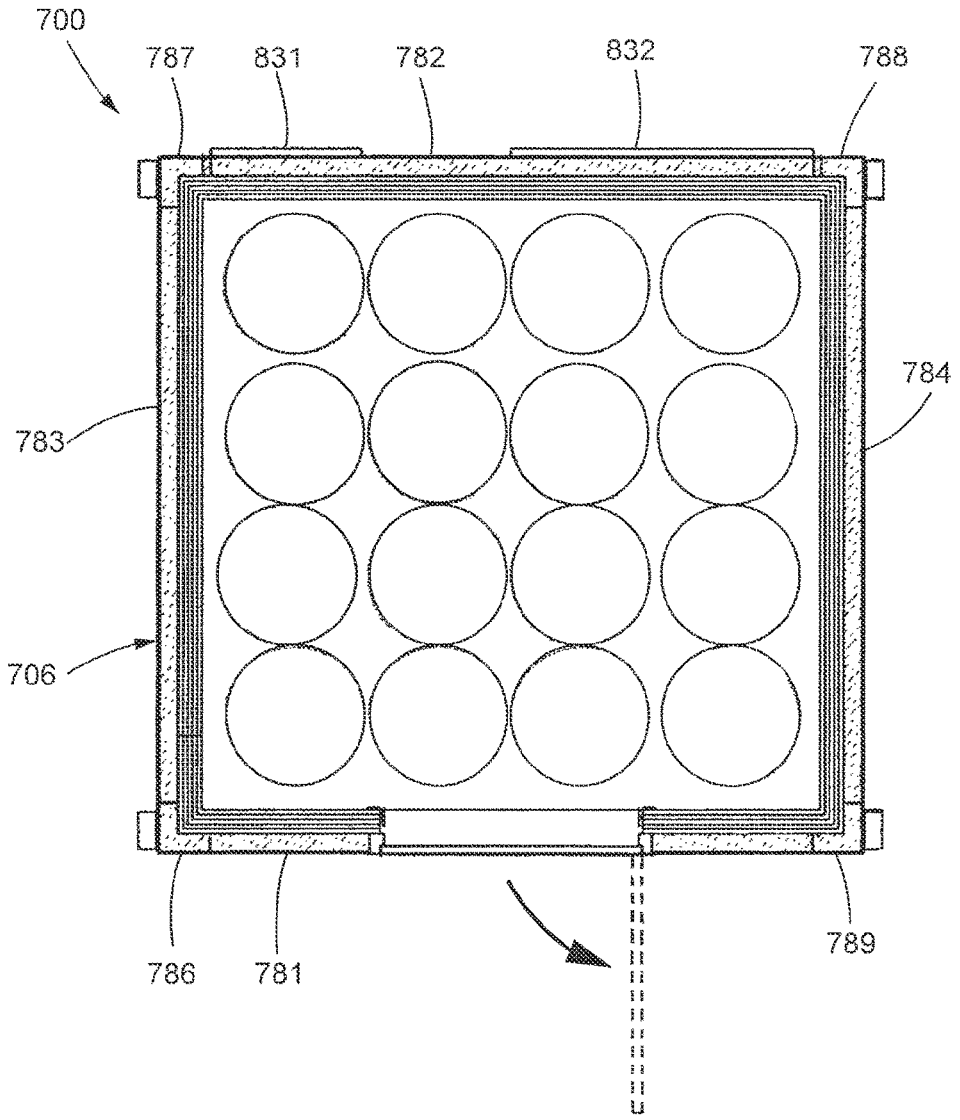
FIG. 47 is a cross-sectional view, taken along line XXXXVII-XXXXVII in FIG. 44, of the modular storage structure of FIG. 44.

Referring to FIGS. 45 and 46, the left side portion 783 and the right side portion 784 can each be equipped with a gravity air flow vents 792, 793, respectively. In embodiments, a fire damper with fusible links can be provided in the vents 792, 793.

Figure 48:
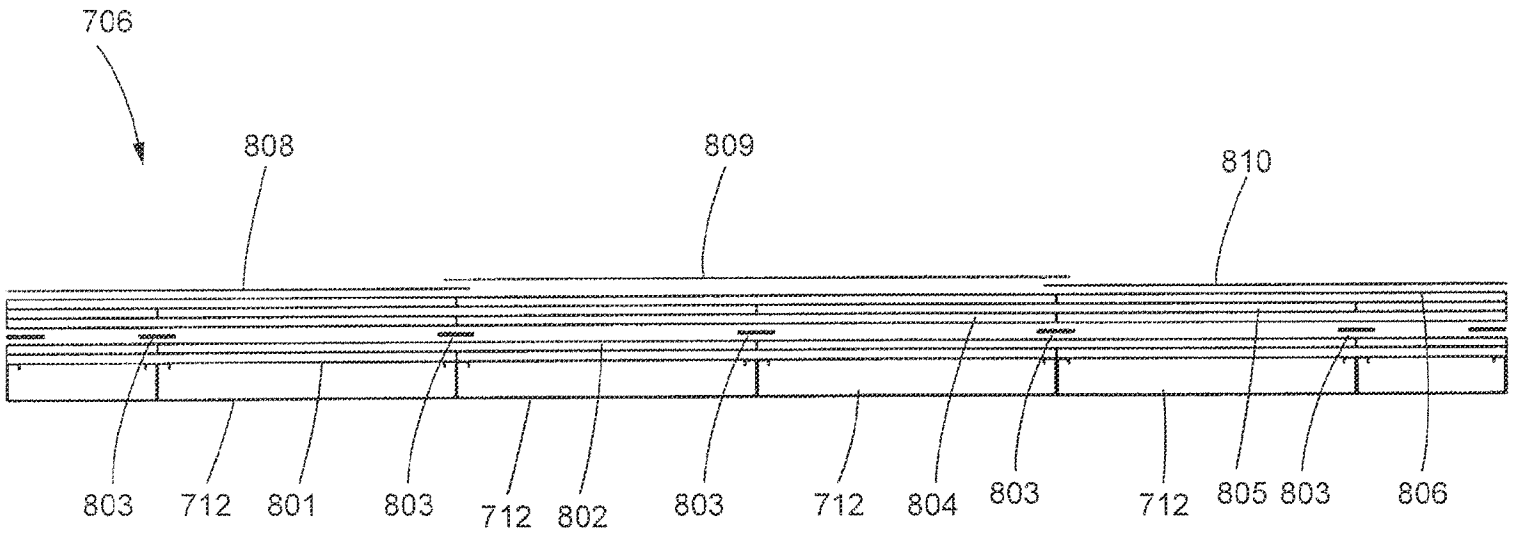
FIG. 48 is a cross-sectional view, taken along line XXXXVIII-XXXXVIII in FIG. 45, of the modular storage structure of FIG. 44.

Referring to FIG. 48, the wall system 706 of the modular storage structure 700 is effective to inhibit the transmission of heat through the wall system 706 such that the wall system 706 meets at least the four-hour uni-directional fire-rating standards according to the specifications of ASTM E119-15 and/or FM Approval Standard 6049. Referring to FIG. 48, first and second gypsum wallboard layers 801, 802 of panels are fastened to the wall panels 712. Stripping 803 in the form of flat sheet metal strips is applies at each panel seam. The stripping 803 runs from the upper ends to the lower ends of the wall panels 712. Third, fourth, and fifth gypsum wallboard layers 804, 805, 806 are applied thereafter. All joints are staggered. Then, cold rolled flat sheet steel 808, 809, 810 is adhered and fastened to the inner surface of the fifth gypsum wallboard layer 806 in an overlapping manner.

Figure 49:
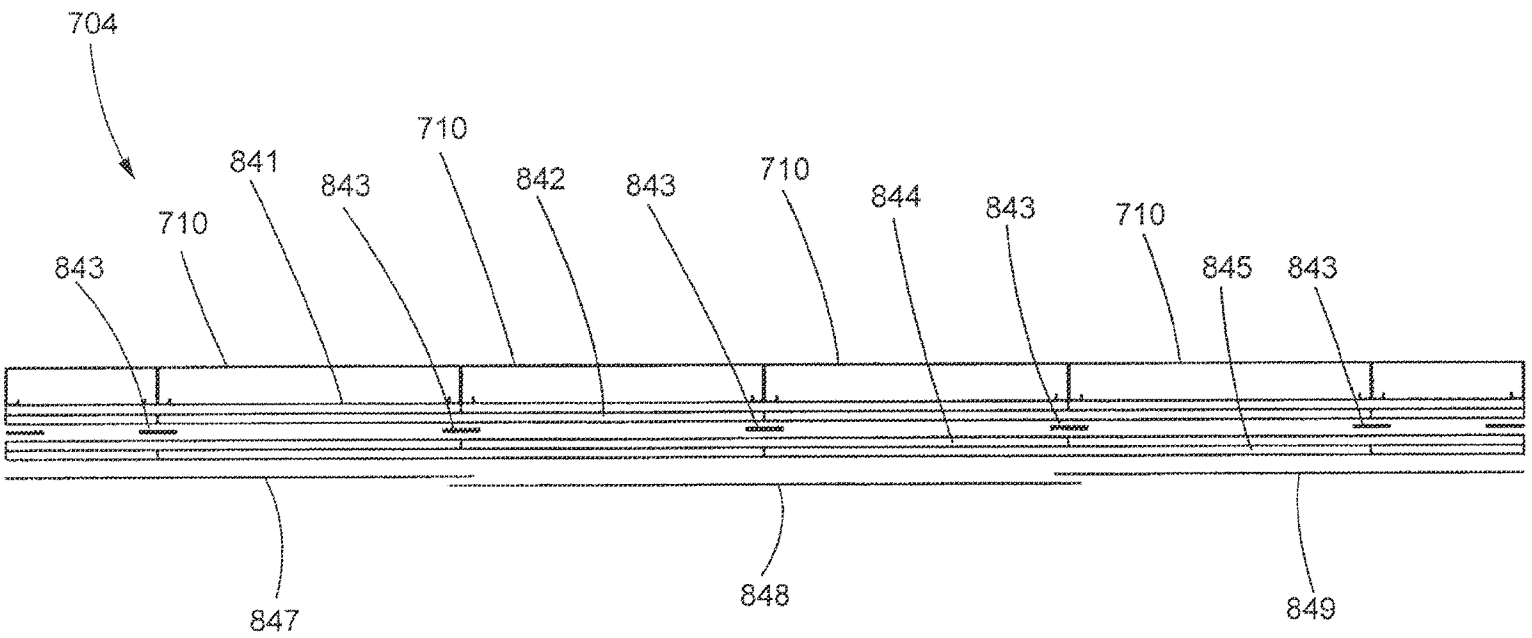
FIG. 49 is a cross-sectional view, taken along line IL-IL in FIG. 45, of the modular storage structure of FIG. 44.

FIG. 49 show construction details of the roof 704. In embodiments, the roof 704 of the modular storage structure 700 is effective to inhibit the transmission of heat through the roof 704 such that the roof 404 meets at least the three-hour fire-rating standards according to the specifications of ASTM E119-15 and/or FM Approval Standard 6049.

The roof 704 includes a plurality of roof panels 710. First and second gypsum wallboard layers 841, 842 of panels are fastened to the roof panels 710. Stripping 843 in the form of flat sheet metal strips is applies at each panel seam. The stripping 843 runs from the end to end of the roof panels 710. Third and fourth gypsum wallboard layers 844, 845 are applied thereafter. All joints are staggered. Then, cold rolled flat sheet steel 847, 848, 849 is adhered and fastened to the inner surface of the fourth gypsum wallboard layer 845 in an overlapping manner.

The modular storage structure 700 of FIGS. 44-49 can be similar in other respects to the modular storage structure 300 of FIGS. 24-35 and to the modular storage structure 100 of FIGS. 1-12. The roof 704 and the wall system 706 of the modular storage structure 700 of FIGS. 44-49 can be similar in other respects to the roof 104 and the wall system 106 of the modular storage structure 100 of FIGS. 1-12.

In embodiments, a method of constructing a structure following principles of the present disclosure can be used to make any embodiment of a storage structure according to principles of the present disclosure. In one embodiment, a method of constructing a includes arranging a plurality of wall panels to form a wall system. Each wall panel includes a lower end, an upper end, a central wall panel portion, and a pair of wall interlock members. The central wall panel portion has an outer surface and an inner surface. The wall interlock members are respectively disposed on opposite sides of the central wall panel portion and extend from the inner surface of the central wall panel portion. Each wall interlock member includes a rib portion extending from the inner surface of the central wall panel portion, a stud portion extending from an outer surface of each rib portion toward the stud portion of the other wall interlock member, and a return segment extending from the stud portion toward the central wall panel portion The wall panels are connected serially together such that the outer surfaces of the rib portion of one of the interlock members of one wall panel is in abutting relationship with the outer surface of the rib portion of one of the interlock members of an adjacent wall panel such that the stud portions of the abutting rib portions extend away from each other to define a wall stud assembly.

In embodiments, a roof is connected to the wall system such that the roof engages respective upper ends of the wall panels so as to define an interior enclosure. In embodiments, at least one wallboard layer is installed such that the first wallboard layer substantially surrounds the interior enclosure defined by the roof and the wall system. The first wallboard layer is in abutting relationship with the roof and in abutting relationship with wall stud assemblies defined by adjacent wall panels.

In another embodiment, a method of constructing a structure following principles of the present disclosure includes providing a plurality of roof panels. Each roof panel includes a substantially flat central roof panel portion and a pair of roof interlock members. For each roof panel, the central roof panel portion has an outer surface and an inner surface, and the roof interlock members are respectively disposed on opposite sides of the central roof panel portion and extend from the inner surface of the central roof panel portion. Each interlock member includes a rib portion extending substantially perpendicularly from the central roof panel portion and a stud portion extending away from an outer surface of each rib portion and substantially parallel to the central roof panel portion. A roof is formed by aligning the roof panels adjacent one another such that the outer surfaces of the ribs of adjacent roof panels abut one another so as to form a series of roof joist assemblies from the stud portions of adjacent roof panels.

A plurality of wall panels can be provided. Each wall panel including a lower end, an upper end, a substantially flat central wall panel portion, and a pair of wall interlock members. For each wall panel, the central wall panel portion has an outer surface and an inner surface, and the wall interlock members are respectively disposed on opposite sides of the central wall panel portion and extend from the inner surface of the central wall panel portion. Each interlock member includes a rib portion extending substantially perpendicularly from the central wall panel portion and a stud portion extending away from an outer surface of each rib portion and substantially parallel to the central wall panel portion. A wall system is formed by aligning the wall panels adjacent one another such that the outer surfaces of the ribs of adjacent wall panels abut one another so as to form a series of wall stud assemblies from the stud portions of adjacent wall panels.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A structure comprising:

a wall system, the wall system including a plurality of wall panels connected serially together, each wall panel having a lower end, an upper end, a central wall portion, and a pair of wall interlock members, the central wall portion having an outer face surface, an inner face surface, and a pair of side edges extending between the upper end and the lower end, and the wall interlock members respectively disposed at the side edges of the central wall portion, each interlock member including a wall rib portion and a wall stud portion, the wall rib portions of the wall interlock members respectively extending, and being planar, from the side edges of the central wall portion to a distal edge thereof, and the wall stud portions of the wall interlock member being planar and respectively extending from the distal edge of the respective wall rib portion toward the wall stud portion of the other wall interlock member, wherein the wall panels are connected together such that the wall rib portion of one of the wall interlock members of one wall panel is in abutting relationship with the wall rib portion of one of the wall interlock members of an adjacent wall panel such that the wall stud portions of the abutting wall rib portions extend away from each other to define a wall stud assembly, wherein the wall system defines an explosion relief panel opening;

a roof, the roof connected to the wall system at the upper ends of the wall panels, the roof and the wall system cooperating together to define an interior enclosure; and an explosion relief panel, the explosion relief panel movably mounted to the wall system, the explosion relief panel being movable between a closed position in which the explosion relief panel occludes the explosion relief panel opening, and an open position in which the explosion relief panel is at least partially offset from the explosion relief panel opening, the explosion relief panel being constructed to move from the closed position outward to the open position when the interior enclosure has a pressure exceeding a predetermined amount, the explosion relief panel having a flange engaging the outer face surface of one of the central wall portions adjacent the explosion relief panel opening;

wherein the wall panels and the explosion relief panel are made from metal.

2. The structure of claim 1, wherein the roof including a plurality of roof panels connected serially together, each roof panel having, a central roof portion, and a pair of roof interlock members, the central roof portion having an outer top surface, an inner top surface, and a pair of lateral edges, and the roof interlock members respectively disposed at the lateral edges of the central roof portion, each roof interlock member extending from the inner top surface of the central roof panel portion, each roof interlock member including a roof rib portion and a roof joist portion, the roof rib portions of the roof interlock members respectively extending from the lateral edges of the central roof portion to a distal edge thereof, and the roof joist portions of the roof interlock member respectively extending from the distal edge of the respective roof rib portion toward the roof joist portion of the other roof interlock member, wherein the roof panels are connected together such that the roof rib portion of one of the roof interlock members of one roof panel is in abutting relationship with the roof rib portion of one of the roof interlock members of an adjacent roof panel such that the roof joist portions of the abutting roof rib portions extend away from each other to define a roof joist assembly.

3. The structure of claim 2, further comprising:

a first wallboard layer, the first wallboard layer having an inner wallboard surface and an outer wallboard surface, the first wallboard layer substantially covering the interior enclosure formed by the roof and the wall system, wherein at least portions of the outer wallboard surface of the first wallboard layer contact the roof joist assemblies formed by adjacent roof panels and at least portions of the outer wallboard surface contact the wall stud assemblies formed by adjacent wall panels.

4. The structure of claim 3, further comprising:

a second wallboard layer, the second wallboard layer substantially surrounding the interior space formed by the roof and the wall system, wherein the second wallboard layer engages the inner wallboard surface of the first wallboard layer.

5. The structure of claim 3, wherein the first wallboard layer does not extend across the explosion relief panel opening.

6. The structure of claim 1, wherein the wall system includes a corner wall panel disposed between two wall panels so as to form a wall corner, the corner wall panel including first and second substantially flat corner portions disposed at an angle to one another and meeting at a corner edge.

7. The structure of claim 6, wherein the first and second corner portions each have an inner surface and an outer surface, and wherein the corner wall panel includes a first corner interlock member with a first corner rib portion extending from the inner surface of the first corner portion and a second corner interlock member with a second corner rib portion extending from the inner surface of the second corner portion.

8. The structure of claim 7, wherein the corner wall panel is disposed such that the first corner rib portion abuts the wall rib portion of one of the wall interlock members of a first adjacent wall panel and the second corner rib portion abuts the wall rib portion of one of the wall interlock members of a second adjacent wall panel.

9. The structure of claim 8, wherein the first corner interlock member includes a first corner stud portion extending substantially away from a distal edge of the first corner rib portion so as to form a first corner stud assembly with the wall stud portion of the abutting interlock member of the first adjacent wall panel.

10. The structure of claim 9, wherein the second corner interlock member includes a second corner stud portion extending substantially away from a distal edge of the second corner rib portion so as to form a second corner stud assembly with the wall stud portion of the abutting interlock member of the second adjacent wall panel.

11. The structure of claim 1, wherein each wall interlock member includes a wall return segment, the wall return segment extending from the wall stud portion toward the central wall portion.

12. The structure of claim 1, further comprising:

a floor, the floor engaging the lower ends of the wall panels.

13. The structure of claim 1, wherein the wall system defines a door opening, the door opening being in communication with the interior enclosure.

14. The structure of claim 13, further comprising:

a pair of stiffeners, each stiffener respectively abutting one of the wall interlocking members and the inner surface of the two wall panels between which the door opening is defined.

15. The structure of claim 14, wherein the stiffener has a stiffener stud portion facing generally away from the inner surface of the central wall portion, the stiffener being disposed against the wall interlocking member so as to form a door stud assembly from the stud portion of the interlocking member and the stiffener stud portion.

16. The structure of claim 1, wherein the explosion relief panel is constructed to move to the open position when the interior enclosure has a pressure exceeding approximately 20 psi.

17. The structure of claim 1, wherein the explosion relief panel is movably mounted to the wall system with a hinge.

* * * * *